US006310334B1

(12) United States Patent
Niwa et al.

(10) Patent No.: US 6,310,334 B1
(45) **Date of Patent: *Oct. 30, 2001**

(54) SURFACE CURRENT HEATING APPARATUS HAVING SPACED-APART HOLLOW HEAT GENERATING MEMBERS WITH CONDUCTOR EXTENDING THERETHROUGH

(75) Inventors: Kunio Niwa; Shinichi Nagasawa, both of Nakatsugawa (JP)

(73) Assignee: NA Corporation, Nakatsugawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,580

(22) Filed: Aug. 31, 1998

(30) Foreign Application Priority Data

Sep. 4, 1997 (JP) ..... 9-239901

(51) Int. Cl.[7] ..... H05B 6/38

(52) U.S. Cl. ..... 219/644; 219/628; 392/441; 392/469

(58) Field of Search ..... 219/628, 629, 219/630, 644; 392/441, 444, 447, 469

(56) References Cited

U.S. PATENT DOCUMENTS 3,622,731 * 11/1971 Ando ..... 219/618
5,390,961 * 2/1995 Guthrie ..... 285/41

FOREIGN PATENT DOCUMENTS 43-16931 7/1968 (JP) .
52-14854 4/1977 (JP) .

* cited by examiner

*Primary Examiner*—Teresa Walberg
*Assistant Examiner*—Shawntina T. Fuqua
(74) *Attorney, Agent, or Firm*—Oliff & Berridge, PLC

(57) ABSTRACT

A surface current heating apparatus including a plurality of hollow heat generating members each of which is made of a ferromagnetic material and has a through-hole and which are spaced apart from each other so as to provide an array of the hollow heat generating members, and an electrically conductive wire electrically insulated and extending through the through-hole of each hollow heat generating member, and wherein an alternating current from a power source is applied to the electrically conductive wire, to cause a surface current to flow through a skin layer of each hollow heat generating member which is located near an inner surface of the through-hole, whereby heat is generated from the said skin layer of the heat generating member.

30 Claims, 19 Drawing Sheets

FIG. 19

| TEST No. | | | | | | | | | | | | | | | | | | | | | | | | |
|---|---|---|---|---|---|---|---|---|---|---|---|---|---|---|---|---|---|---|---|---|---|---|---|---|
| | | | | | | | | | | | | | | | | | | | | | | | | |
| NUMBER OF WIRE TURNS | | T | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| DC RESISTANCE | | Ω (APPROX.) AT 20°C | 0.42 | 0.42 | 0.42 | 0.42 | 0.42 | 0.29 | 0.21 | 0.42 | 0.42 | 0.42 | 0.42 | 0.42 | 0.29 | 0.21 | 0.42 | 0.42 | 0.42 | 0.42 | 0.29 | 0.21 | 0.42 | 0.42 |
| VOLTAGE | | V | 22.8 | 23.0 | 23.0 | 23 | 14.2 | 10.6 | 14.2 | 14.0 | 14.8 | 14.6 | 9.2 | 6.4 | 22.8 | 23.0 | 23.0 | 23 | 14.2 | 10.6 | 14.2 | 14.0 | 14.8 | 14.6 |
| CURRENT | | A | 10.0 | 10.0 | 10.0 | 10.0 | 10.0 | 10.0 | 5.0 | 5.0 | 5.0 | 5.0 | 5.0 | 5.0 | 10.0 | 10.0 | 10.0 | 10.0 | 10.0 | 10.0 | 5.0 | 5.0 | 5.0 | 5.0 |
| WIRE TURN NUMBER X CURRENT | | AT | 120 | 120 | 120 | 120 | 120 | 120 | 60 | 60 | 60 | 60 | 60 | 60 | 120 | 120 | 120 | 120 | 120 | 120 | 60 | 60 | 60 | 60 |
| HEAT GENERATING TUBES | LENGTH OF EACH TUBE | mm | 1000±0.5 | 250±0.2 | 50±0.1 | 27±0.1 | 12±0.1 | 6±0.1 | 1000±0.5 | 250±0.2 | 50±0.1 | 27±0.1 | 12±0.1 | 6±0.1 | 1000±0.5 | 250±0.2 | 50±0.1 | 27±0.1 | 12±0.1 | 6±0.1 | 1000±0.5 | 250±0.2 | 50±0.1 | 27±0.1 |
| | NUMBER OF TUBES | N | 2 | 8 | 40 | 74 | 100 | 150 | 2 | 8 | 40 | 74 | 100 | 150 | 2 | 8 | 40 | 74 | 100 | 150 | 2 | 8 | 40 | 74 |
| | TOTAL LENGTH | m | 2.0 | 2.0 | 2.0 | 2.0 | 1.2 | 0.9 | 2.0 | 2.0 | 2.0 | 2.0 | 1.2 | 0.9 | 2.0 | 2.0 | 2.0 | 2.0 | 1.2 | 0.9 | 2.0 | 2.0 | 2.0 | 2.0 |
| INPUT POWER (TOTAL HEAT GENERATED) | | W | 220 | 215 | 212 | 216 | 135 | 100 | 65.0 | 65.0 | 69.0 | 69.0 | 43.5 | 30.0 | 220 | 215 | 212 | 216 | 135 | 100 | 65.0 | 65.0 | 69.0 | 69.0 |
| COPPER LOSS | | W | 42 | 42 | 42 | 42 | 29 | 21 | 10.5 | 10.5 | 10.5 | 10.5 | 7.3 | 5.3 | 42 | 42 | 42 | 42 | 29 | 21 | 10.5 | 10.5 | 10.5 | 10.5 |
| ELECTROMAGNETIC LOSS | | W | 178 | 173 | 170 | 174 | 106 | 79 | 54.5 | 54.5 | 58.5 | 58.5 | 36.2 | 24.7 | 178 | 173 | 170 | 174 | 106 | 79 | 54.5 | 54.5 | 58.5 | 58.5 |
| ELECTROMAGNETIC LOSS PER METER | | W/m | 89 | 86 | 85 | 87 | 88 | 88 | 27.3 | 27.3 | 29.2 | 29.2 | 30.1 | 27.4 | 89 | 86 | 85 | 87 | 88 | 88 | 27.3 | 27.3 | 29.2 | 29.2 |

FIG. 20

| TEST No. | NUMBER OF WIRE TURNS | DC RESISTANCE | CURRENT | WIRE TURN NUMBER × CURRENT | SPECIMENS | INPUT POWER (TOTAL HEAT GENERATED) | COPPER LOSS | ELECTRO-MAGNETIC LOSS | ELECTRO-MAGNETIC LOSS PER METER |
|---|---|---|---|---|---|---|---|---|---|
| | T | Ω (APPROX.) AT 20°C | A | AT | | W | W | W | W/m |
| 1 | 12 | 0.42 | 10.0 | 120 | STEEL TUBE ARRAYS WITH INSULATED CONDUCTIVE WIRE | 205 | 42 | 163 | 82 |
| | | | 7.5 | 90 | | 130 | 23.6 | 106 | 53 |
| | | | 5.0 | 60 | | 66 | 10.5 | 55 | 28 |
| | | | 3.0 | 36 | | 25 | 3.8 | 21 | 11 |
| 2 | 12 | 0.42 | 10.0 | 120 | STEEL TUBE ARRAYS WITH INNER VINYL-COVERED CLASS-1 METALLIC FLEXIBLE CONDUCTIVE TUBES | 217 | 42 | 176 | 88 |
| | | | 8.0 | 96 | | 157 | 27 | 131 | 65 |
| | | | 6.0 | 72 | | 92 | 15 | 77 | 39 |
| | | | 5.0 | 60 | | 69 | 10.5 | 58.5 | 29 |
| | | | 3.0 | 36 | | 28 | 3.8 | 24.2 | 12 |
| 3 | 12 | 0.42 | 10.0 | 120 | VINYL-COVERED CLASS-1 METALLIC FLEXIBLE CONDUCTIVE TUBES ONLY | 50 | 42 | 8 | 4.0 |
| | | | 7.5 | 90 | | 30 | 24 | 6 | 3.0 |
| | | | 6.0 | 72 | | 27.5 | 15 | 12.5 | 6.0 |
| | | | 5.0 | 60 | | 17.5 | 10.5 | 7.0 | 3.5 |
| 4 | 12 | 0.42 | 10.0 | 120 | INSULATED CONDUCTIVE WIRES ONLY | 46 | (42) | 4 | 2 |
| | | | 7.5 | 90 | | 25 | (24) | 1 | 0.5 |
| | | | 6.0 | 72 | | 15 | (15) | 0 | 0 |
| | | | 5.0 | 60 | | 9.5 | (10.5) | −1.0 | −0.5 |

FIG. 21

| PERFORATED HEAT GENERATING MEMBER | | | | | | | | | | | | |
|---|---|---|---|---|---|---|---|---|---|---|---|---|
| | | TOTAL LENGTH = TOTAL THICKNESS (CALCULATED) | NUMBER OF WIRE TURNS | DC RESISTANCE | VOLTAGE | CURRENT | WIRE TURN NUMBER × CURRENT | INPUT POWER (TOTAL HEAT GENERATED) | COPPER LOSS | ELECTROMAGNETIC LOSS | ELECTROMAGNETIC LOSS PER METER |
| | | m | T | Ω (APPROX.) AT 27°C | V | A | AT | W | W | W | W/m |
| HEAT GENERATOR | ROUND PLANE WASHER | 1.04 | 10 | 0.29 | 22.5 | 10.0 | 100 | 190 | 29 | 161 | 155 |
| | | | | | 18.5 | 8.0 | 80 | 120 | 19 | 101 | 100 |
| | | | | | 12.0 | 5.0 | 50 | 45 | 7.0 | 38 | 37 |
| | POLYGON PLANE WASHER | 1.04 | 10 | 0.40 | 35.0 | 10.0 | 100 | 322 | 40 | 282 | 271 |
| | | | | | 28.0 | 8.0 | 80 | 195 | 25.5 | 170 | 163 |
| | | | | | 20.0 | 5.0 | 50 | 84 | 110.0 | 74 | 71 |

FIG. 22

| TYPE | TEST RESULT | | | | | | | TEST INVOLVED |
|---|---|---|---|---|---|---|---|---|
| | HEAT GENERATING PORTION | NUMBER OF WIRE TURNS × CURRENT | COPPER LOSS Ω (APPROX.) AT 20°C | ELECTROMAGNETIC LOSS | ELECTROMAGNETIC LOSS/COPPER LOSS | ELECTROMAGNETIC LOSS PER METER | W/m | |
| STEEL TUBES | TWO WATER PIPES SGP-B-20A | 120 AT | 42 W | 178 W | 4.2 | 89 | | TEST No. 1 OF FIG. 19 |
| | 74 PIPES SGP-B-20A (LENGTH EQUAL TO OD) WITH TOTAL LENGTH OF APPROX. 2m | 120 AT | 42 W | 174 W | 4.1 | 87 | | TEST No. 7 OF FIG. 19 |
| STEEL PLATES | 400 ROUND PLANE WASHERS WITH TOTAL THICKNESS OF 1.04m | 100 AT | 29 W | 161 W | 5.6 | 155 | | FIG. 21 |
| | 334 POLYGON PLANE WASHERS WITH TOTAL THICKNESS OF 1.04m | 100 AT | 40 W | 282 W | 7.0 | 271 | | FIG. 21 |

SURFACE CURRENT HEATING APPARATUS HAVING SPACED-APART HOLLOW HEAT GENERATING MEMBERS WITH CONDUCTOR EXTENDING THERETHROUGH

This application is based on Japanese Patent Application No. 9-239901 filed on Sep. 4, 1997, the content of which is incorporated hereinto by reference.

BACKGROUND OF THE INVENTION

1. Field of the Invention

The present application relates in general to a surface current heating apparatus, and more particularly to such a heating apparatus suitable for small-scale heating applications.

2. Discussion of the Related Art

A known surface current heating apparatus includes a heat generating tube made of a ferromagnetic material, and an electrically conductive wire extending through the heat generating tube such that the conductive wire is electrically insulated. In operation, an alternating current is applied from an AC power source to the conductive wire, so that a surface current flows near the inner circumferential surface of the heat: generating tube, causing the heat generating tube to generate heat. The heat generating tube is a tubular member made of a steel or other ferromagnetic material. Generally, the conductive wire is electrically insulated at its surface with an organic or inorganic insulator.

The surface current heating apparatus was originally developed for heating a pipe line, and has been used for various applications, as snow-melting or anti-freezing heating devices, industrial heat sources, and heaters such as panel heaters, as disclosed in Japanese Patent Applications laid-open for opposition purpose as Publication Nos. 43-16931 and 52-14854. The snow-melting or anti-freezing heating devices include those for roadways, floors and walls. The industrial heat sources include those for boilers, hot water supplies and plating baths.

Conventionally, the surface current heating apparatus of the type mentioned above uses a heat generating tube which is as long as possible for a particular application of the apparatus. That is, commercially available steel tubes of various nominal lengths are used where the specific heating apparatus allows the use of a steel tube of a particular nominal length. Where the heating apparatus does not permit the use of any of such steel tubes of nominal lengths, due to a limited length of installation space for the steel tube in the apparatus, a steel tube of an appropriate nominal length is cut to a desired length suitable for use in the apparatus.

However, the present inventors discovered that the use of a long heat generating tube or tubes is not necessarily advantageous, and that the use of a relatively large number of heat generating tubes each having a comparatively small length is more advantageous in most cases of small-scale heating or heat generating applications. The inventors recognized potential advantages of a surface current heating apparatus which uses a heat generating member or members in the form of a plate, block or slab having through-holes through which an electrically conductive wire extends.

SUMMARY OF THE INVENTION

It is therefore an object of the present invention to provide a surface current heating apparatus or a combination of a plurality of such surface current heating apparatuses, which is suitable for small-scale heating applications.

The above object may be achieved according to any one of the following modes or forms of the present invention. Like the appended claims, these modes of the invention are numbered, and each mode refers to the number or numbers of the other mode or modes, where appropriate, to indicate possible combinations of features or elements of the two or more modes of the invention described below.

(1) A surface current heating apparatus comprising: a plurality of hollow heat generating members each made of a ferromagnetic material and having a through-hole, the hollow heat generating members being spaced apart from each other so as to provide at least one array of the hollow heat generating members; and an electrically conductive wire electrically insulated and extending through the through-hole of each hollow heat generating member, an alternating current from a power source being applied to the electrically conductive wire, to cause a surface current to flow through a skin layer of each hollow heat generating member which is located near an inner surface of the through-hole, whereby heat is generated from the skin layer.

As described below in detail, the hallow heat generating members may be heat generating tubes each having a comparatively small axial length, or plates or blocks each having a through-hole. In essence, each hollow heat generating member is required to be made of a ferromagnetic material and have a through-hole through which the electrically conductive wire extends, and a comparatively large transverse cross sectional area which provides a closed magnetic path.

Upon application of an electric current to the electrically conductive wire, a magnetic field is produced around the conductive wire. In the presence of the hollow ferromagnetic heat generating members each having a closed magnetic path around the conductive wire, lines of magnetic force produced by application of the electric current to the conductive wire tend to be concentrated within each hollow ferromagnetic heat generating member. Further, the lines of magnetic forces tend to gather and to be concentrated in the skin layer of the heat generating member near the inner surface of the through-hole. Where an alternating current is applied to the conductive wire, the magnetic flux density periodically changes, and there arise a voltage and a current in the hollow heat generating member, so as to disturb the periodic change of the magnetic flux density. As a result, a surface current flows through the skin layer of the hollow heat generating member near its through-hole, in a direction perpendicular to the lines of magnetic force, so that the skin layer near the inner surface of the through-hole is concentratively heated. If the two or more hollow heat generating members are arranged in mutually spaced-apart relationship with each other, there is provided a relatively large surface area for heat radiation, than where only an electrically conductive or resistive wire is used to generate heat. The present heating apparatus is capable of generating a large amount of heat while restricting the temperature rise at the highest-temperature portion of the apparatus.

The present invention provides various advantages which will be described in detail with respect to preferred modes, forms or arrangements of the invention. Each of the features described below need not be provided or is not essential for each of the arrays of the hollow heat generating members. Heat generating members which do not have such a feature or features may be provided in the present heating apparatus. For instance, the conductive wire may be disposed to extend through a long heat generating tube as used in the prior art, under a specific environment, for example, where the conductive wire should be completely protected, or where the heat generating tube has a particularly high property of heat radiation.

(2) A surface current heating apparatus according to the above mode (1), wherein the at least one array of the hollow heat generating members includes at least one array consisting of a plurality of heat generating tubes each of which has an axial length no more than 20 times an outside diameter thereof.

Where the plurality of heat generating tubes are arranged along a curve, the array of these heat generating tubes may extend along either a plurality of circular arcs or curves or a plurality of straight lines. When the heat generating tubes have comparatively small lengths, these heat generating tubes may be arranged along two or more curved lines which cooperate to define a desired curve along which the array of the heat generating tubes extends. The heat generating tubes may be formed such that the centerline of each tube is curved along a circular arc or such that the centerlines of the tubes are curved along respective different circular arcs. These curved heat generating tubes may be readily arranged along a desired curve. In this case, the length of the curved tube is expressed by the length of its centerline. For easier manufacture, it is desirable that all heat generating tubes of the same array have the same outside diameter. However, this is not essential. That is, the heat generating tubes of the same array may have different outside diameters. In this instance, the upper limit of the axial length of each heat generating tube having the specific outside diameter is 20 times the outside diameter.

The amount of heat generated per unit length of each array of the heat generating tubes having the relatively small lengths according to the above mode (2) is almost the same as that of a single heat generating tube. Where the length of each heat generating tube is not larger than 20 times the outside diameter, the heat generating tubes can be easily arranged along a desired path. Where a single heat generating tube is installed over a given distance in the location of use, a long tube must be cut in situ to the length suitable for covering that distance, so that the heat generated by the heat generating tube is generated evenly over the entire distance. In the present mode of the invention wherein the relatively short heat generating tubes are arranged in an array, the length of the array can be easily adjusted by suitably selecting the number of the heat generating tubes and the spacing between the adjacent heat generating tubes, depending upon the length of the location of use. Thus, the present form of the invention does not require cutting of a long heating generating tube in situ, namely, at the location of use. Where a long heat generating tube is installed so as to extend along a curve or along a sharp corner, the long heat generating tube must be curved or bent. The use of the relatively short heat generating tubes according to the present mode of the invention permits the heat generating tubes to be easily arranged along a. desired curve or corner.

Further, the present mode (2) of this invention facilitates adjustment of distribution of the heat generated by the surface current heating apparatus. The amount of heat generated by unit length of the array of the heat generating tubes can be adjusted by changing the outside diameter of the heat generating tubes, as well as by changing the amount of the alternating current to be applied to the conductive wire and/or changing the number of the conductive wires passed through the heat generating tubes. However, it is desirable to minimize the numbers of the outside diameters of the heat generating tubes used, for reducing the cost of manufacture of the heat generating tubes by mass production, and/or for facilitating the designing of the surface current heating apparatus or the installation at the location of use. In this respect, the present invention makes it possible to use the heat generating tubes of the same outside diameter, while permitting easy adjustment of the distribution of the amount of heat generated per unit length of the array of the heat generating tubes, by suitably changing the pitch at which the heat generating tubes are arranged.

The heat generating tubes may oscillate and generate a noise, at a resonance frequency which is a multiple of the frequency of the alternating current flowing through the conductive wire. In a relatively small-scale application of the surface current heating apparatus, such oscillation and noise generation is undesirable in most cases. Where the length of the relatively short heat generating tubes is relatively small as in the present mode (2) of the invention, however, the resonance frequency is relatively high, so that the oscillation and noise generated by the relatively short heat generating tubes do not cause a serious problem. It is noted that a tubular body may undergo axial oscillation (periodic change of its length) and torsional oscillation about its axis, as well as bending oscillation in the direction perpendicular to the axis. The oscillation of the heat generating tubes referred to above is the bending oscillation, which may cause a problem in a surface current heating apparatus.

In a small-scale application of the surface current heating apparatus, the apparatus tends to require a larger amount of heat generated per unit length of the array of the heat generating tubes, than in a large-scale application. To avoid an excessive rise of the temperature within the heat generating tubes, particularly, the temperature of the conductive wire, it is inevitable to use the conductive wire whose insulating material is expensive or which is difficult to handle. This problem may be effectively solved according to the present mode of the invention. Heat generated by the heat generating tube is efficiently emitted at the opposite end portions of the tube, that is, by radiation from the end faces and the inner circumferential surface at the opposite end portions of the tube and by convection through the ambient fluid. Where the heat generating tube has a relatively large length, the ratio of the amount of heat emitted at the end portions of the tube to the entire amount of heat emitted from the tube is considerably low, namely, most of the heat is emitted from the outer circumferential surface of the tube. Where the heat generating tubes arranged in an array are relatively short, the heat is considerably emitted from the end faces and the inner circumferential surface at the end portions of each tube, whereby the total heat radiating surface area is accordingly increased, making it possible to minimize the temperature rise within the heat generating tubes, in particular, the temperature rise of the conductive wire and its insulating layer.

In addition, the short heat generating tubes may be easily subjected to an anti-rust treatment. Generally, a surface current heating apparatus is used for a long time. Therefore, it is desirable to increase the durability of the heat generating tubes by subjecting the tubes to the anti-rust treatment. Where the heat generating member has a large length, it is difficult to perform the anti-rust treatment. Where the heat generating member is a long tube, the anti-rust treatment of the inner circumferential surface of the tube is particularly difficult. Where the hollow heat generating members are short heat generating tubes as in the above mode (2) of the invention, the tubes may be readily subjected to the anti-rust treatment.

Further, the short heat generating tubes may be formed by pressing operation, and are available at a lower cost than a long tube, which is generally expensive.

Where the heat generating tubes are embedded in a concrete slab, for example, the use of the short tubes is effective to solve a problem which would be encountered due to a difference in the thermal expansion between the heat generating tubes and the concrete slab. Where the long heat generating tube of an iron material is embedded in the concrete slab, there arises a difference in the amount of thermal expansion between the heat generating tube and the concrete slab, due to a difference in the thermal expansion coefficient between the iron and the concrete and a difference in the temperature between the heat generating tube and the concrete slab. Accordingly, the heat generating tube may be separated from the concrete slab, or the concrete slab may suffer from cracking. Where the length of the heat generating tubes is small as in the present mode of the invention, the difference in the thermal expansion amount between the heat generating tubes and the concrete slab is relatively small, the problem indicated above will not take place.

The heat generating tubes according to the present mode (2) of this invention, the length of each heat generating tube is made relatively small for enjoying at least one of the advantages discussed above. However, the cost per unit length of the array of the heat generating tubes generally increases with a decrease in the length of each tube. In this sense, the length of the heat generating tubes has a preferred range, which varies depending upon the advantage or advantages sought by decreasing the length, or the degree in which the advantage is sought. Generally, the upper limit of the preferred range of the length of the heat generating tubes is 20, 15, 10, 5, 3 or 2 times or 1 time the outside diameter. Where the heat generating tubes are arranged along a curve such as a circular arc, the upper limit of the preferred range of the length is 3 or 2 times, or 1, ⅔ or ½ times the outside diameter.

(3) A surface current heating apparatus according to the above mode (1), wherein the at least one array of the hollow heat generating members includes at least one array each consisting of a plurality of heat generating tubes which are arranged along a substantially entire portion of a closed loop, and the electrically conductive wire extends through each array of the heat generating tubes and along the closed loop, an axial length of a shortest one of the heat generating tubes in each array being no more than 1/7 of a total length of said at least one array of the heat generating tubes.

In a small-scale application of the surface current heating apparatus, the conductive wire is often wound so as to provide two or more turns along a closed loop which passes through an array consisting of a plurality of heat generating tubes. In this case, the heat generating tubes are arranged along the closed loop. The heat generating tubes may be considered to be arranged along a substantially entire portion of a closed loop, where those heat generating tubes are arranged in two parallel straight arrays through which the conductive wire is passed, with its opposite end portions extending from the corresponding ends of the two arrays, and with its intermediate portion extending between the other ends of the two arrays. For any of the reasons explained above with respect to the preferred mode (2) of this invention, the upper limit of the length of the heat generating tubes is desirably 1/7, 1/10 or 1/20 of the total length of the at least one array of the heat generating tubes.

(4) A surface current heating apparatus according to the above mode (3), wherein the at least one array of the heat generating tubes includes a straight array of the heat generating tubes each having an axial length no more than ⅓ of a length of the straight array.

Where the heat generating tubes are arranged along a straight line, the length of the heat generating tubes in this straight array can be made relatively large, unlike the length of the heat generating tubes which are arranged along a curved line, as in the following mode (5) of the invention. In the present mode (4), therefore, the upper limit of the length of the heat generating tubes is desirably ⅓, ⅕ or 1/10 of the length of the straight array.

(5) A surface current heating apparatus according to the above mode (1) or (4), wherein the at least one array of hollow heat generating members includes at least one curved array each consisting of a plurality of heat generating tubes which are arranged along a curved line which can be approximated by a circular arc, each of the heat generating tubes having an axial length no more than ⅙ of a circumference of a circle which includes the circular arc.

Where the heat generating tubes are arranged along a curved line, this curved line can be approximated by a circular arc. The upper limit of the length of each heat generating tube in this case can be determined by the ratio of the length to the circumference of the circle which includes the circular arc. The upper limit is desirably ⅙, 1/10, 1/15 or 1/20 of the circumference of the circle indicated above.

(6) A surface current heating apparatus according to the above mode (1), wherein the at least one array of hollow heat generating members includes at least one array of heat generating tubes which are axially spaced apart from each other by a distance no more than three times an axial length of the heat generating tubes.

The amount of heat radiation from each array of the heat generating tubes increases with an increase in the spacing distance between the adjacent heat generating tubes. On the other hand, the amount of heat generated per unit length of the array decreases with the increase in the spacing distance. Accordingly, the preferred range of the spacing distance of the heat generating tubes must be determined by taking into account these facts and the length of the heat generating tubes. Generally, the upper limit of the preferred range of the spacing distance is 3 or 2 times, or 1 or ½ times the length of each heat generating tube, while the lower limit of the preferred range is 1/20, 1/10, ⅕ or ⅓ of the length. The relatively large values of the ratio of the spacing distance to the length are more likely to apply to the heat generating tubes having comparatively small lengths, while the relatively small values of the ratio are more likely to apply to the heat generating tubes having comparatively large lengths.

Although the "heat generating tubes" described above with respect to the preferred modes (2)–(6) are typically tubes whose transverse cross sectional shape is circular, the heat generating tubes may take other shapes in the transverse cross section, such as an ellipse and a polygon. For the heat generating tubes having non-circular transverse cross sectional shapes, the "outside diameter" may be interpreted to mean one of: the largest external dimension of the shape; an average of the largest and smallest external dimensions of the shape; a square root of an average of squares of the largest and smallest external dimensions of the shape; and the outside diameter of a circle whose circumference is equal to the perimeter of the shape.

(7) A surface current heating apparatus according to any one of the above modes (1)–(6), wherein the plurality of heat generating members include a plurality of plates each having a through-hole.

To enjoy the advantage of this mode of this invention, it is desirable to use a large number of heat generating plates, for example, at least 20, 50 or 100 plates.

The heat generating plates may have a desired shape such as a polygon, a circle or an ellipse. The term "plates" is defined herein as a member whose thickness is no more than ⅔ of the largest external dimension. A hollow heat generating member consisting of a tubular portion and a flange portion radially outwardly extending from the tubular portion may be considered as a heat generating tube if the tubular portion is a major portion of the member, and as a heat generating plate if the flange portion is a major portion of the member. Such a hollow heat generating member may be formed by drawing a blank in the form of a sheet into the tubular portion, by casting or forging so as to form the tubular and flange portions integrally with each other, by press-fitting the tubular member into the flange member, or by welding the tubular member to the flange member.

Usually, the heat generating plates are arranged in a direction perpendicular to the plane of each plate such that the plates are spaced apart from each other in the direction of the thickness. However, the plates may be arranged such that the plane of each plate is inclined with respect to the direction of arrangement. In an unusual case, the plates are arranged such that the planes of the plates lie in a single plane or in parallel to a curved surface. In this case, the conductive wire is passed through the through-holes of the adjacent plates in the opposite directions, alternately, such that the conductive wire extends through one of the adjacent plates from the front side toward the back side, and then through the other plate from the back side toward the front side, for example. The hollow heat generating plates may consist of a combination or mixture of plates and tubes.

The heat generating plates, which have a comparatively large surface area for heat radiation, are capable of generating a relatively large amount of heat while avoiding an excessive rise of the temperature at the inner surface of the through-holes, so as to restrict or limit the temperature rise of the conductive wire and its insulating layer.

(8) A surface current heating apparatus according to any one of the above modes (1)–(7), wherein the plurality of the hollow heat generating members include a plurality of blocks each having a through-hole.

To enjoy the advantage of this mode of the invention, it is desirable to use a large number of heat generating blocks, for instance, at least 4, 10 or 20 blocks.

Rectangular parallelopipeds are a typical example of the heat generating blocks. However, the blocks may have any transverse cross sectional shapes, such as a polygon, a circle or an ellipse. The hollow heat generating members which cannot be considered as the "tubes" or "plates" may be considered as the "blocks". The hollow heat generating members may consist of a combination or mixture of the blocks and the tubes and/or plates.

The amount of heat that can be generated by the heat generating blocks are most largely influenced by the size of the through-holes as seen in the transverse cross section and the length of the through-holes, as long as the external dimension of the blocks is sufficiently larger than the internal dimension. In this respect, the inside diameter and the axial length of the bores (through-holes) of the heat generating tubes should be considered regarding the amount of heat generated by the tubes. In ordinary tubes, however, the inside diameter tends to increase with an increase in the outside diameter. Therefore, the heat generating tubes are defined by their outside diameter and axial length only. This definition also applies to the tubes having non-circular transverse cross sectional shapes. On the other hand, the plates and blocks do not meet the general concept of the tubes that the internal dimension increases with an increase in the external dimension. Since the amount of heat generated by the plates or blocks is largely influenced by the transverse cross sectional dimension and the length of the through-holes, a reasonable definition of the plates and blocks should depend upon the transverse cross sectional dimension and the length of the through-holes. Where the through-holes are circular holes, the transverse cross sectional dimension may be the diameter or circumference of the circular holes. Where the through-holes have non-circular transverse cross sectional shapes, the transverse cross sectional dimension may be an average of the largest and smallest dimensions of the through-holes or a perimeter of the through-holes in the transverse cross section.

(9) A surface current heating apparatus according to any one of the above modes (1)–(8), further comprising a flexible tube which is flexible and which extends through the through-hole of each hollow heat generating member, and wherein the electrically conductive wire extends through the flexible tube.

While the conductive wire is preferably covered by an electrically insulating layer, it: is more preferable that the conductive wire is protected by the externally disposed flexible tube. Electrically insulated wires which are used for electrical wiring in buildings, for example, are usually protected by flexible tubes. For securing electrical safety and durability of the present surface current heating apparatus comparable to those of the electrical wiring in the buildings, the electrically insulated conductive wire is desirably passed through a flexible tube. For preventing generation of heat from the flexible wire during application of the alternating current to the conductive wire, the flexible tube preferably takes one of the following forms, in order to minimize the heat generation from the flexible tube.

(10) A surface current heating apparatus according to the above mode (9), wherein the flexible tube is made of a non-metallic material.

(11) A surface current heating apparatus according to the above mode (9), wherein the flexible tube is made of a non-magnetic metallic material.

(12) A surface current heating apparatus according to the above mode (9), wherein the flexible tube has a thickness not larger than a thickness of a cylindrical wall of a heat generating tube as each heat generating member.

(13) A surface current heating apparatus according to the above mode (9), wherein the flexible tube is made of a magnetic metal and has a transverse cross sectional shape which is not magnetically closed.

(14) A surface current heating apparatus according to any one of the above modes (1)–(13), further comprising a heat radiating member including: a heat collecting portion made of a non-magnetic metal and interposed between an inner surface of the through-hole of each hollow heat generating member and the electrically conductive wire, for collecting the heat generated from the skin layer of each hollow heat generating member; and a heat radiating portion located outside each hollow heat generating member, for radiating the heat collected by the heat collecting portion.

The present mode of the invention makes it possible to effectively restrict the temperature rise of the conductive wire which would take place by heat generation due to copper loss of the conductive wire per se and by the heat that is generated by the heat generating member and transferred from the inner surface of the through-holes to the conductive wire. That is, the heat collecting portion collects both the heat generated by the copper loss of the conductive wire and the heat transferred from the inner surface of the through-holes to the conductive wire. The thus collected heat is transferred by conduction through the heat collecting portion to the heat radiating portion, so that the heat is radiated from the heat radiating portion to the outside of the heat generating members, whereby the temperature rise of the conductive wire is limited or restricted.

(15) A surface current heating apparatus according to the above mode (14), wherein the heat collecting portion of the heat radiating member includes a heat collecting tube located inside each heat generating member, and the heat radiating portion includes a heat radiating fin which extends radially outwardly from the heat collecting tube, the apparatus further comprising an adiabatic layer disposed between the heat collecting tube and the hollow heat generating member, the adiabatic layer having a coefficient of thermal expansion lower than those of the heat collecting tube and the hollow heat generating member.

Where the adiabatic layer disposed between the inner surface of the through-hole of the hollow heat generating member and the heat collecting tube contains a gaseous fluid such as air, the heat is transferred from the inner surface of the through-hole to the heat collecting tube by radiation through the adiabatic layer. Where the adiabatic layer is formed of a solid material as in the preferred mode (17) described below, the heat is transferred to the heat collecting tube by conduction through the solid material. In either of these cases, the heat transferred to the heat collecting tube is transferred to the heat radiating fin by conduction through the heat collecting tube, and is radiated from the heat radiating fin to the outside of the heat generating member. Accordingly, the resistance to heat transfer from the conductive wire to the outside of the heat generating member is lower in the present heating apparatus, than in the heating apparatus which does not include the heat radiating member. In the presence of the heat radiating member, the amount of heat which is transferred from the inner surface of the through-hole of the heat generating member to the conductive layer is also reduced, resulting in a decrease in the amount of temperature rise of the conductive wire.

(16) A surface current heating apparatus according to the above mode (15), wherein the heat collecting tube includes an axially central portion, and axially opposite end portions which are located on opposite sides of the axially central portion, the heat radiating fin extending radially outwardly from an outer circumferential surface of the axially central portion of the heat collecting tube, the axially opposite end portions being respectively located within adjacent ones of the plurality of hollow heat generating members.

In the heating apparatus according to the above mode of the invention, the heat radiating members and the hollow heat generating members may be readily assembled by repeating the following steps: inserting one of the opposite end portions of one of the heat collecting tubes into one of two axial portions of one of the hollow heat generating members; inserting the other end portion of the same heat collecting tubes into one of two axial portions of another of the hollow heat generating member; and inserting one of the opposite end portions of another of the heat radiating tubes into the other axial portion of the above-indicated another hollow heat generating member. It is preferred to arrange the adjacent two heat radiating members such that the end portions of these two heat radiating members which end portions are inserted into the same hollow heat generating member are butted together within this hollow heat generating member, so that the portion of the conductive wire corresponding to the hollow heat generating member is completely enclosed in the two adjacent end portions of the two adjacent heat radiating members.

(17) A surface current heating apparatus according to the above mode (15) or (16), wherein the adiabatic layer is formed of a solid material.

Where the adiabatic layer is formed of a ceramic material, a synthetic resin material, a glass fiber or other solid material, the adiabatic layer can function as a layer for maintaining a predetermined radial clearance or gap between the inner surface of the hollow heat generating member and the outer surface of the heat collecting tube.

(18) A surface current heating apparatus according to any one of the above modes (1)–(17), wherein the plurality of hollow heat generating members are embedded in a solid member made of a non-magnetic material, so as to provide a one-piece structure.

Where the hollow heat generating members are embedded in a solid member so as to provide a one-piece structure, the heating apparatus including a desired number of such one-piece structures can be easily installed at a desired location. For instance, the one-piece structure may be a square, rectangular or polygon block. A multiplicity of these blocks are arranged end to end so as to cover a desired area of a floor, ground or road surface, for holding that area at a desired temperature. Since the solid member of each one-piece structure is made of a non-magnetic material, the solid member does not have an influence on the magnetic field produced around the conductive wire, permitting the hollow heat generating members to generate heat as intended. Further, the one-piece structure is available at a relatively low cost owing to mass production thereof with the same shape and size. The conductive wire and the flexible tube may also he embedded in the solid member during manufacture of the one-piece structure. Alternatively, the conductive wire and the flexible tube may be inserted between the solid member and the hollow heat generating members after the one-piece structure is produced.

(19) A surface current heating apparatus according to the above mode (18), wherein the solid member is made of a material which is not electrically conductive.

Where the solid member is made of a non-electrically-conductive material, a possible contact of the solid member with the conductive wire would not cause leakage of the electric current, assuring improved safety of the surface current heating apparatus.

(20) A surface current heating apparatus according to the above mode (18), wherein the material of the solid member is selected from a group consisting of: concrete; synthetic resin; gypsum; and ceramic material.

The concrete, synthetic resin or gypsum in its mushy or uncured state may be cured or solidified at a comparatively low temperature, without deteriorating the organic insulating material if used for the conductive wire, when the hollow heat generating members are embedded in the solid member. Where the non-electrically-conductive material of the solid member is a ceramic material, two ceramic members which cooperate to form cavities for accommodating the hollow heat generating members and the conductive wire are formed by firing appropriate green bodies, and the hollow heat generating members (and the conductive wire and/or the flexible tube, as well, if desired) are disposed between the two ceramic members such that the heat generating members are accommodated in the cavities. The two ceramic members and the heat generating members are fixed together by suitable means, to produce the one-piece structure.

(21) A surface current heating apparatus according to any one of the above modes (18)–(20), wherein a space within each hollow heat generating member is filled with a portion of the solid member such that an inner surface of the through-hole is in contact with the material of that portion of the solid member.

In this mode of the invention wherein the space within each hollow heat generating member is filled with the material of the solid member, the heat is transferred from the inner surface of the through-hole of each heat generating member to the solid member, making it possible to restrict the temperature rise at the inner surface of the through-hole, thereby making it possible to easily restrict the temperature rise of the conductive wire.

(22) A combination consisting of a plurality of one-piece structures each constructed according to any one of the above modes (18)–(21).

The combination according to the above mode (22) is typically a combination of the one-piece structures according to the above mode (18), but may be a combination of U-shaped heater blocks, a combination of step boards for stairs, or a combination of panels for walls.

(23) A surface current heating apparatus according to any one of the above modes (1)–(8) and (14)–(22), further comprising a support tube made of a non-magnetic metal and extending through the through-hole of each hollow heat generating member, and wherein the electrically conductive wire extends through the support tube.

The support tube according to this mode (23) and the following mode (24) is provided primarily for supporting the conductive wire and the hollow heat generating members. Unlike the flexible tube described above, the support tube need not have flexibility. An assembly wherein the conductive wire and the hollow heat generating members are supported by the support tube may be easily handled as a single structure. Further, the support tube made of a non-magnetic metal does not have an influence on the magnetic field produced around the conductive wire, and does not disturb the heat generating function of the hollow heat generating members. The metallic support tube whose cylindrical wall thickness is relatively small can be comparatively easily bent along a desired curved so that the hollow heat generating members as such tubes are arranged along the curved line. In addition, the metallic support tube completely encloses the conductive wire, which is otherwise locally exposed between the spaced-apart hollow heat generating members. Thus, the support tube improves physical protection of the conductive wire. Further, the metallic support tube assures electrical protection of the conductive wire, where the support tube is connected to the ground for releasing a leakage current to the ground. Where the support tube is made of aluminum, copper or other material having a high degree of thermal conductivity, the conductive wire has an even temperature distribution in the longitudinal direction, making it possible to effectively prevent local deterioration of the insulating layer of the conductive wire.

(24) A surface current heating apparatus according to any one of the above modes (1)–(8) and (14)–(22), wherein each of the plurality of hollow heat generating members consists of a heat generating tube, the apparatus further comprising a support tube made of a magnetic material and having a cylindrical wall thickness no more than ⅕ of that of the heat generating tube, the support tube extending through the heat generating tube while the electrically conductive wire extending through the support tube.

Even where the support tube is made of a magnetic material, the amount of heat generated by the support tube is not so large as to adversely influence the function of the heating apparatus, provided the cylindrical wall thickness of the support tube is sufficiently smaller than that of the heat generating tube.

(25) A surface current heating apparatus according to any one of the above modes (1)–(8) and (14)–(22), further comprising a support tube made of a magnetic metal and having a transverse cross sectional shape which does not provide a closed magnetic path, the support tube extending through the through-hole of each hollow heat generating member, and wherein the electrically conductive wire extends through the support tube.

Even where the support tube is made of a magnetic material, the amount of heat generated by the support tube is not so large as to adversely influence the function of the heating apparatus, provided the transverse cross sectional shape of the support tube does not provide a closed magnetic path.

(26) A surface current heating apparatus according to any one of the above modes (1)–(14) and (23)–(25), further comprising a holder device for holding the plurality of hollow heat generating members in a mutually spaced-apart relationship with each other, while permitting flows of a fluid through the through-hole of each hollow heat generating member to an outside of each hollow heating generating member.

Where the hollow heat generating members are held by the holder device so as to maintain a predetermined spacing distance or distances between the adjacent hollow heat generating members, each array of the hollow heat generating members is capable of maintaining a desired distribution of the heat generated. Further, the holder device does not disturb the flows of the ambient fluid through the through-holes of the hollow heat generating members, so that the heat is transferred from the inside of the hollow heat generating members by mans of the fluid into the outside of the heat generating members, whereby the temperature rise of the conductive wire is limited. The surface current heating apparatus according to the present mode (26) of this invention is particularly suitable for air heating, for temperature control of liquid baths such as a plating bath, and for heating the ambient fluid.

BRIEF DESCRIPTION OF THE DRAWINGS

The above and optional objects, features, advantages and technical and industrial significance of this invention will be better understood by reading the following detailed description of presently preferred embodiments of the invention, when considered in connection with the accompanying drawings, in which:

FIG. 19 is a table indicating a result of the experiment;

FIG. 20 is a table indicating a result of another experiment;

FIG. 21 is a table indicating a result of a further experiment; and

FIG. 22 is a table indicating a result of some of the tests in the experiment on the heat generating tubes of FIG. 19, and a result of tests in an experiment on the heat generating members in the form of plates.

DETAILED DESCRIPTION OF THE PREFERRED EMBODIMENTS

Figure 1:
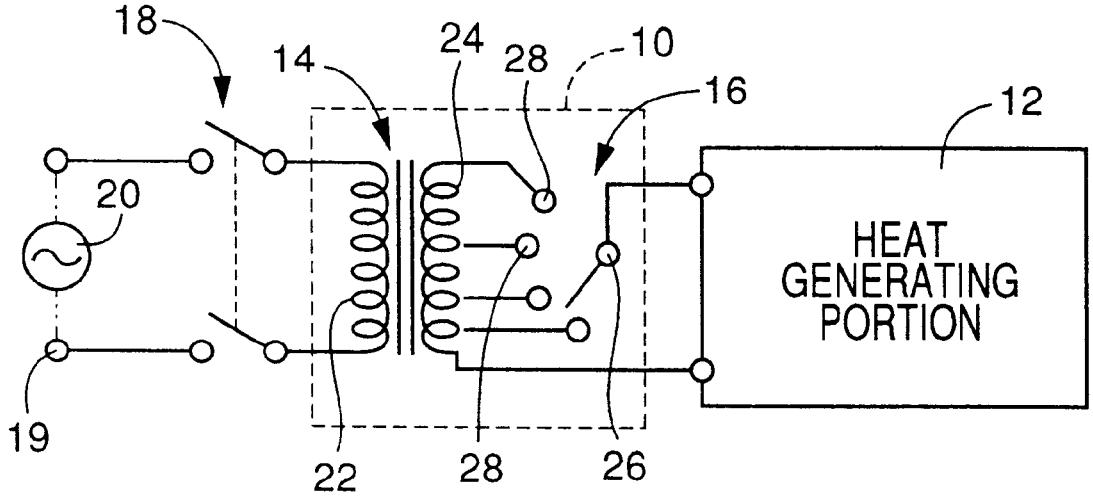
FIG. 1 is a circuit diagram schematically illustrating an arrangement of a surface current heating apparatus according to one embodiment of this invention.

Referring first to FIG. 1, there is shown a surface current heating apparatus constructed according to one embodiment of this invention, which includes an AC power source circuit 10 and a heat generating portion 12. The AC power source circuit 10 includes a transformer 14 and a selector switch 16, and is connected to a commercially available power source 20 through a main switch 18 and a connector terminal 19.

The transformer 14 includes a primary winding 22 and a secondary winding 24. The secondary winding 24 has one common terminal 26, and a plurality of selector terminals 28 connected to respective coils of wire of different turns. However, the AC power source circuit 10 may be replaced by an AC power source circuit including a single winding transformer having a single winding and a sliding brush which slides on the single winding. Alternatively, the circuit 10 may be replaced by an AC power source circuit equipped with a transformer and a forward-reverse parallel single-phase alternating current switch. In the latter case, the transformer is used for electric energy transformation and for insulation, while the forward-reverse parallel single-phase alternating current switch includes thyristors connected in parallel in the forward and reverse directions and is adapted to control the ignition phase of the thyristors to thereby control the range of the phase in which the current flow is allowed. The forward-reverse parallel single-phase alternating current switch is a kind of AC power source circuit of phase control type. It is also possible to use an AC power source circuit including a transformer and an inverter. The inverter converts an alternating current into a direct current, and then converts the direct current into an alternating current, and functions to transform the output power by changing at least one of the voltage and frequency.

The AC power source circuit 10 is preferably arranged to be able to adjust the supply voltage in steps or continuously. However, this arrangement is not essential. The AC power source circuit 10 may be simply arranged to be automatically turned on and off depending upon the temperature of the heat generating portion 12, or may be adapted to supply an alternating current from a commercially available single-phase or three-phase power source directly to the heat generating portion 12, without transforming the voltage or frequency of the supply power.

Figure 2:
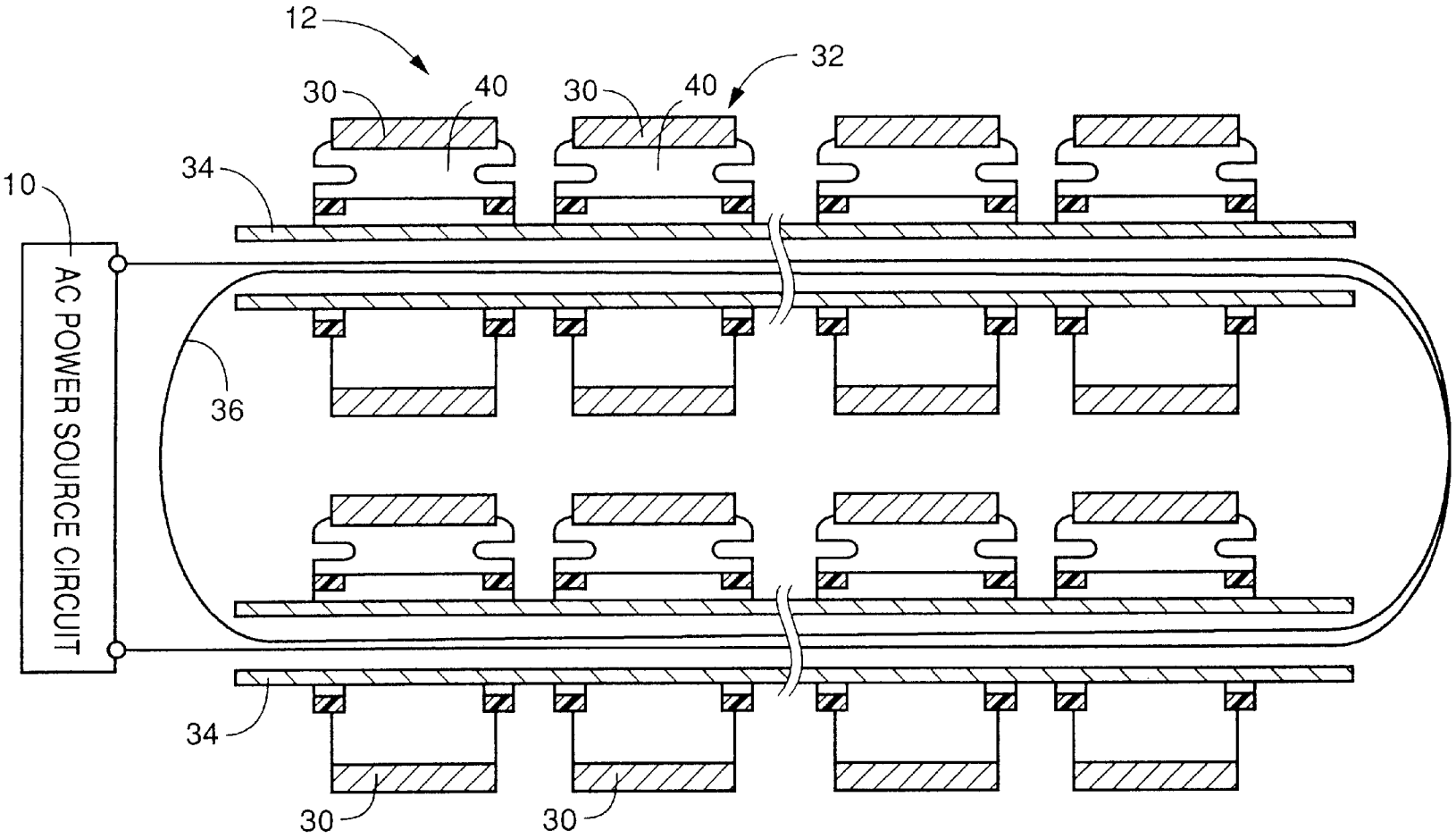
FIG. 2 is a front elevational view in cross section of one example of a heat generating portion of the heating apparatus of FIG. 1.

An example of the heat generating portion 12 is schematically shown in FIG. 2, wherein reference numeral 30 denotes steel tubes functioning as hollow heat generating members in the form of heat generating tubes. Each of the steel tubes 30 has a length or axial dimension which is about two times its diameter. The steel tubes 30 are arranged along two straight lines. The steel tubes 30 arranged along each straight line constitute a steel tube array 32. The spacing between the adjacent steel tubes 30 in each steel tube array 32 is selected within a range between ⅕ and ½ of the outside diameter of the steel tubes 30, that is, within a range between 1/10 and ¼ of the length of the steel tubes 30. The steel tubes 30 are obtained by cutting a commercially available steel tube having a relatively large nominal length, into pieces having a desired length, and finishing the end faces of each piece. The steel tube 30 is shaped and dimensioned so as to satisfy the following relationships: $T \geqq 2S$; and $D >> S$, wherein "D" and "T" represent the inside diameter and the wall thickness of the steel tube 30, respectively, while "S" represents the skin depth (cm) of the steel tube 30, which is equal to $5030\sqrt{\rho/\mu f}$. "ρ" and "μ" represent the resistivity and the permeability of the steel material of the steel tube 30, while "f" represents the frequency of the alternating current.

For each of the two steel tube arrays 32, there is disposed a support tube 34 which extends through the steel tubes 30. An electrically insulated conductive wire 36 extends through the bores of the steel tubes 30 of the two arrays 32, more precisely, through the bores of the support tubes 34.

The conductive wire 36 is a electrically conductive copper wire covered by an outer insulating layer of an organic insulating material in the form of a heat-resistant vinyl chloride resin. The conductive wire 36 extends through the two steel tube arrays 32 in series such that the conductive wire 36 has a plurality of turns. Described in detail, the conductive wire 36 is passed through the bores of the two support tubes 34 extending through the respective two steel tube arrays 32, such that the conductive wire 36 has two or more turns, and extends externally from the corresponding ends of the two support tubes 34, for connection at its opposite ends to the AC power source circuit 10.

Each support tube 34 is a tube made of a hard vinyl, polyethylene or other synthetic resin material, which may or may not be reinforced by reinforcing fibers such as glass fibers. The support tubes 34 support the conductive wire 36 on its inner circumferential surface, and the steel tubes 30 on its outer circumferential surface. The support tubes 34 function to protect the conductive wire 36 from being damaged by contact with the steel tubes 30 or any other external members. The support tubes 34 made of a synthetic resin do not have an adverse effect on the magnetic field to be generated around the conductive wire 36 by application of an alternating current to the conductive wire 36, so that the steel tubes 30 generate heat as if the support tubes 34 were not provided. The support tubes 34 may be eliminated where the steel tubes 30 and conductive wire 36 need not be protected.

Figure 3:
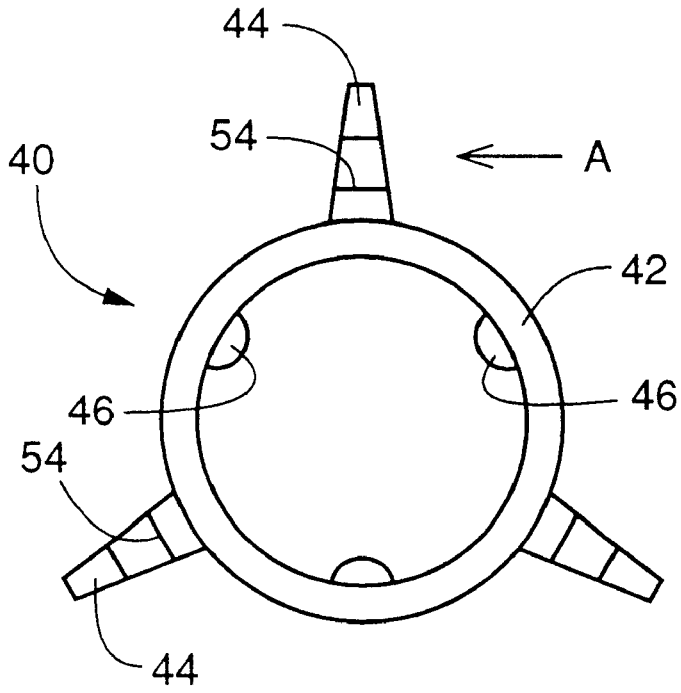
FIG. 3 is a front elevational view of a holder member used in the heat generating portion of FIG. 2.
Figure 4:
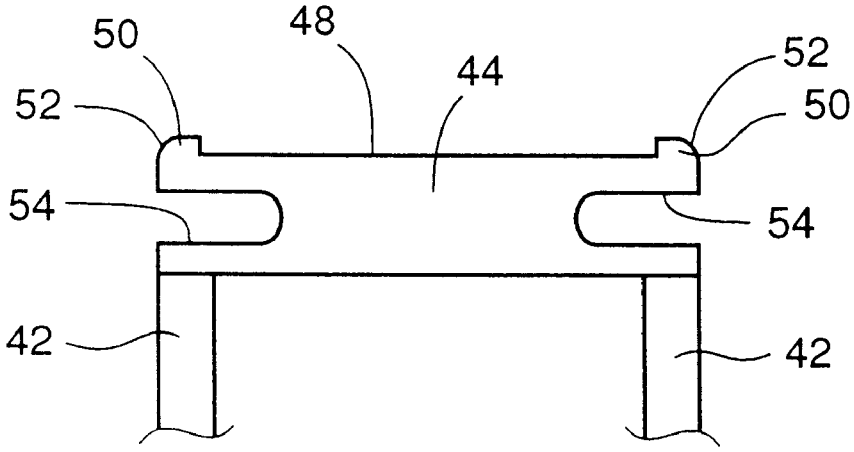
FIG. 4 is a view taken in the direction of arrow A in FIG. 3.

Each steel tube 30 is supported by the outer circumferential surface of the support tube 34 through a holder member 40, which is a one-piece body of a synthetic resin. As shown in FIGS. 3 and 4, the holder member 40 has a pair of ring portions 42, and three holder portions 44. Each ring portion 42 has three protrusions 46 protruding from its inner circumferential surface such that the protrusions 46 are spaced apart from each other at an angular interval of 120° in the circumferential direction of the ring portion 42. The dimension of these protrusions 46 in the radial direction of the ring portion 42 is determined so that the diameter of an inscribed circle contacting the protrusions 46 is slightly smaller than the outside diameter of the support tubes 34. With the ring portions 42 being fitted on the respective support tubes 34, each ring portion 42 is elastically deformed in the radially outward direction so as to have an increased diameter at its circumferential portions from which the protrusions 46 extend, and in the radially inward direction so as to have a reduced diameter at its circumferential portions intermediate between the adjacent protrusions 46, so that the ring portion 42 has a variation in the diameter at different circumferential positions. In this state, the support tube 34 is elastically clamped by the pair of ring portions 42 in the radially inward direction, with a suitable amount of friction resistance between the ring portions 42 and the support tube 34, so that the holder member 40 is prevented from moving relative to the support tube 34 in the axial direction, under a normal condition, that is, unless a force acting between the holder member 40 and the support tube 34 in the axial direction exceeds the friction force therebetween.

As shown in FIG. 3, the three holder portions 44 extend from the outer circumferential surfaces of the pair of ring portions 42 in the radially outward direction, such that the three holder portions 44 are spaced apart from each other at an angular interval of 120° in the circumferential direction of the ring portions 42, with each holder portion 44 being located intermediate between the adjacent protrusions 46 in the circumferential direction of the ring portions 42. Each holder portion has a generally plate-like shape, and a top end having a rectangular recess 48 whose opposite ends are defined by respective projections 50, as shown in FIG. 4. This rectangular recess 48 has a relatively small depth and has a length or axial dimension for accommodating the axial dimension of the steel tube 30, as indicated in FIG. 2. Each projection 50 has a ramp surface 52 which is inclined such that the height of the projection 50 increases in the axial direction of the holder portion 44 from the corresponding axial end toward the axially intermediate portion. The holder member 40 is inserted into the appropriate steel tube 30, from one of the opposite axial ends of the steel tube 30, such that the holder portions 44 are radially inwardly compressed, with the ramp surface 52 of the corresponding projection 50 being in pressing contact with the inner circumferential surface of the steel tube 30. The ramp surface 52 permits the projection 50 to be located outside the steel tube 30, at the other axial end of the steel tube 30, after the holder member 40 has been axially moved relative to the steel tube 30 by a distance corresponding to the length of the steel tube 30. To facilitate the elastic compressive deformation of the holder portions 44, each holder portion 44 has two cutouts 54 open at its axially opposite ends, at an intermediate position in the direction of its height, as shown in FIG. 4.

In assembling the heat generating portion 12 of the present surface current heating apparatus, each of the steel tubes 30 is initially mounted on the holder member 40 in the manner described above, to obtain a sub-assembly of the steel tube 30 and the holder member 40. Each sub-assembly thus obtained is mounted on the outer circumferential surface of the appropriate support tube 34. The steel tube 30 is held in position in the axial direction by the appropriate holder member 40, while the holder members 40 are held at the appropriate axial position on the support tubes 34 under a friction force therebetween, so that the steel tubes 30 are supported by the support tubes 34 with high stability, such that the steel tubes 30 on each support tube 34 are spaced apart from each other in the axial direction of the support tube 34 with a predetermined spacing between the adjacent steel tubes 30. Thus, the holder members 40 function not only as a device for holding the spacing between the adjacent steel tubes 30 in the axial direction of the support tube 34, but also as a device for holding the radial spacing between the steel tubes 30 and the support tube 34. Further, each holder member 40 consisting of only the pair of ring portions 42 and the three holder portions 44 connecting the two ring portions 42 permits smooth free flows of the ambient fluid between the support tube 34 and the steel tubes 30 and through relatively ample spaces provided by the holder member 40. Thus, the holder member 40 is constructed to permit smooth free flows of the fluid therethrough.

For more accurate positioning of the steel tubes 30 in the axial direction with a higher degree of consistency in the axial spacing between the adjacent steel tubes 30, a suitable spacer is desirable interposed between the adjacent holder members 40. For example, the spacer consists of a pair of ring portions similar to the ring portions 42, and connecting portions which extend in the axial direction of the holder members 40 so as to connect the pair of ring portions and which are spaced apart from each other in the circumferential direction of the holder members 40. When the spacers are interposed between the adjacent holder members 40, the ring portions 42 need not be adapted to generate a friction force with respect to the support tube 34, particularly where the spacers have radially inward protrusions similar to the protrusions 46. For positioning the steel tubes 30 at different spacing distances between the adjacent steel tubes, spacers having different lengths are required. The spacer may be formed as an integral part of each holder member 40, preferably so as to permit smooth free flows of the ambient fluid therethrough.

Figure 5:
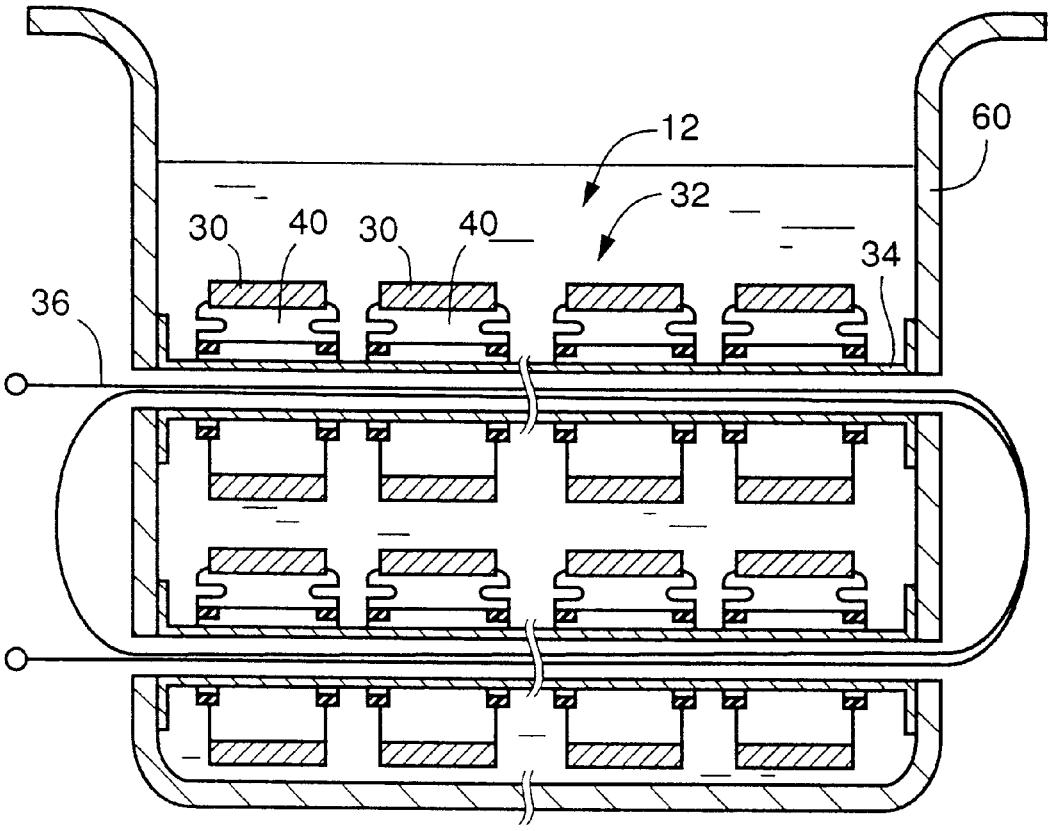
FIG. 5 is a front elevational view in cross section of the heat generating portion of FIG. 2 installed in a liquid bath.

The heat generating portion 12 constructed as described above may be installed in a liquid bath 60 as shown in FIG. 5. The liquid bath 60 may be a plating liquid bath in a plating apparatus, or a hot water bath. Alternatively, the heat generating portion 12 may be installed in an air heating casing of a heating apparatus. In operation, an electric current suitably adjusted by the AC power source circuit 10 is applied to the conductive wire 36, so that a surface current flows through the heat generating steel tubes 30, with a higher degree of current density in a relatively thin skin layer near the inner circumferential surface of each steel tube 30, whereby the skin layer generates heat. Further, the conductive wire 36 generates a small amount of heat due to copper loss. The heat generated from the skin layer of each steel tube 30 is transferred from the inner circumferential surface directly to the ambient fluid, and to the outer circumferential surface and the opposite end faces of the steel tube 30 by conduction through the cylindrical wall of the steel tube 30. Consequently, the heat is transferred to the ambient fluid through the inner and outer circumferential surfaces and the opposite end faces of the steel tubes 30, so that the fluid is heated in contact with a larger surface area of the steel tubes 30, than in the conventional surface current heating apparatus wherein the heat is transferred to the ambient fluid through only the outer circumferential surface of a relatively long heat generating tube.

In addition, the heat generated due to the copper loss of the conductive wire 36 is transferred to the support tubes 34, and a part of the heat generated by the heat generating steel tubes 30 is transferred to the support tubes 34 through radiation (through the ambient gas, in particular). However, since the radial clearances between the steel tubes 30 and the support tubes 34 are kept constant by the holder members 40 over the entire circumference of the support tubes 34, the conductive wire 36 can be effectively protected against local temperature rise and consequent local deterioration of the insulating layer of the conductive wire 36. In the case where the heat generating portion 12 is installed within the liquid bath 60, the steel tubes 30 are subjected to a suitable anti-rust treatment such as plating or coating of an anti-rust agent.

Figure 6:
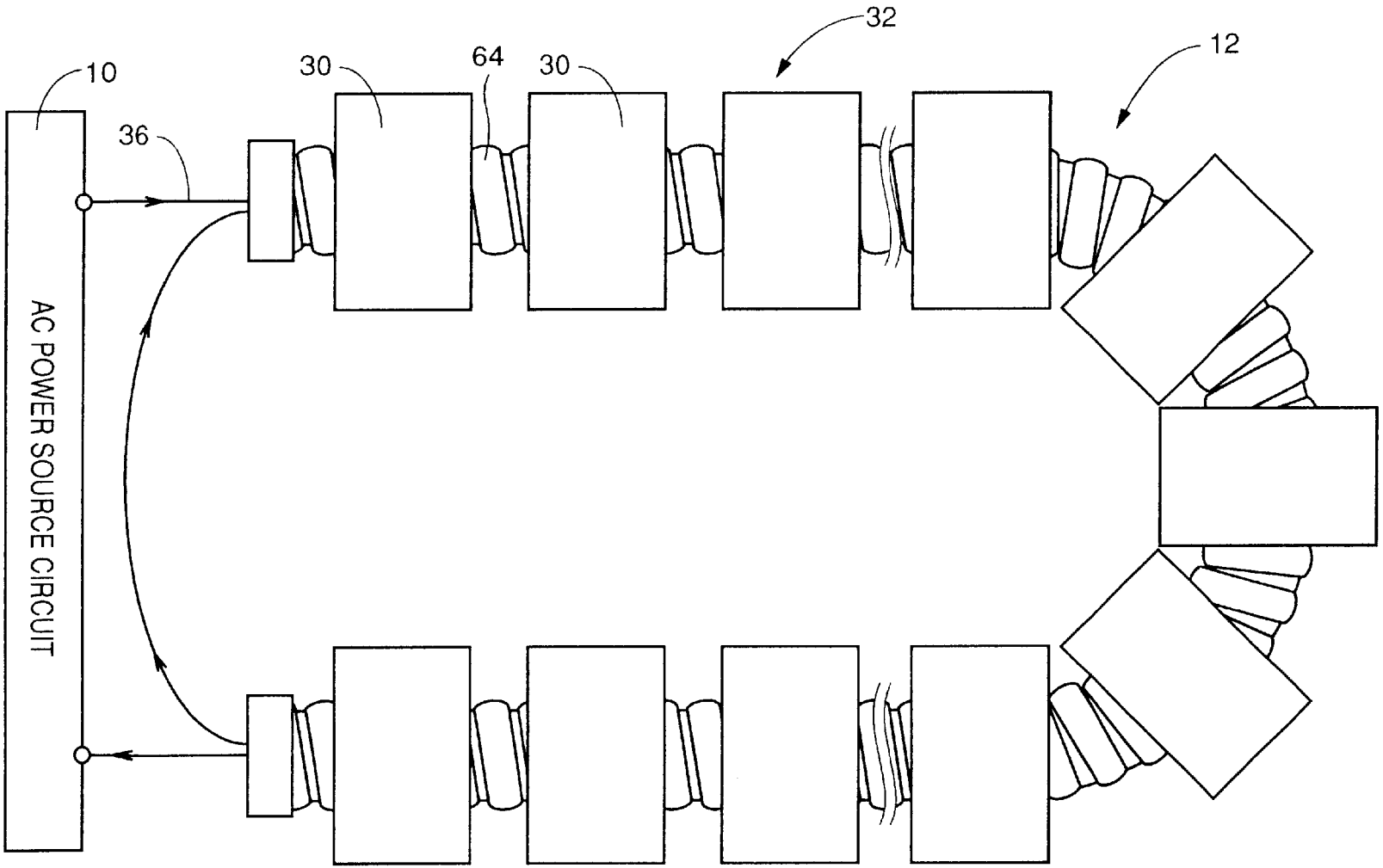
FIG. 6 is a front elevational view of a heat generating portion of a surface current heating apparatus according to another embodiment of this invention.

Referring next to FIG. 6, the heat generating portion 12 according to another embodiment of this invention will be described. In this embodiment, a flexible tube 64 is used in place of the support tubes 34 used in the first embodiment of FIG. 2. In the other aspects, the present second embodiment is identical with the first embodiment, except for the length of each steel tube 30 and the dimensions of the holder members 40 (not shown in FIG. 6 in the interest of simplification). That is, the length of each steel tube 30 used in the second embodiment of FIG. 6 is smaller than that in the first embodiment, for example, almost equal to the outside diameter, so that the steel tube array 32 can be easily curved or bent along a desired line. The holder members 40 used with the flexible tube 64 have larger axial dimensions at its ring portions 42 and protrusions 46, so that the holder members 40 can be mounted with high stability on the flexible tube 64 whose outer surface has helical projections.

In the present embodiment, all of the steel tubes 30 have the same length, for increased flexibility of the arrangement. Where the steel tube array 32 is fixed in pattern of arrangement of the steel tubes 30 with predetermined straight and curved portions, for example, the length of the steel tubes 30 of the straight portion of the array 32 may be made larger than that of the steel tubes 30 of the curved portion of the array 32. Where the steels tubes 30 having different lengths are selectively arranged in situ depending upon the straight and curved portions of the array 32, too, the relatively long steel tubes 30 are used for the straight portion, while the relatively short steel tubes 30 are used for the curved portion.

The flexible tube 64 is an electrical wiring metallic flexible tube (e.g., JIS C8309) widely used for electrical wiring in buildings, and is produced by helically winding a cold-rolled steel strip or aluminum alloy strip which has been subjected to plastic working so as to form parallel raised and recessed portions extending in the longitudinal direction. The flexible tube 64 thus produced is easily flexible. Where the metallic flexible tube 64 is produced from a cold-rolled steel strip, this metallic flexible tube 64 also generates heat upon application of an alternating current to the conductive wire 36. However, the amount of heat generated by the flexible tube 64 is not so large as to cause an adverse effect on the function of the heating apparatus, since the cylindrical wall of the flexible tube 64 consisting of the helically wound strip does not have a completely closed magnetic path, and since the wall thickness is considerably small. This aspect will be further described by reference to a result of an experiment. Commercially available electrical wiring metallic flexible tubes usable as the flexible tube 64 include those coated with a vinyl chloride resin. For improved durability of the flexible tube 64, it is recommended to use such a metallic flexible tube coated with a vinyl chloride resin.

Figure 7A:
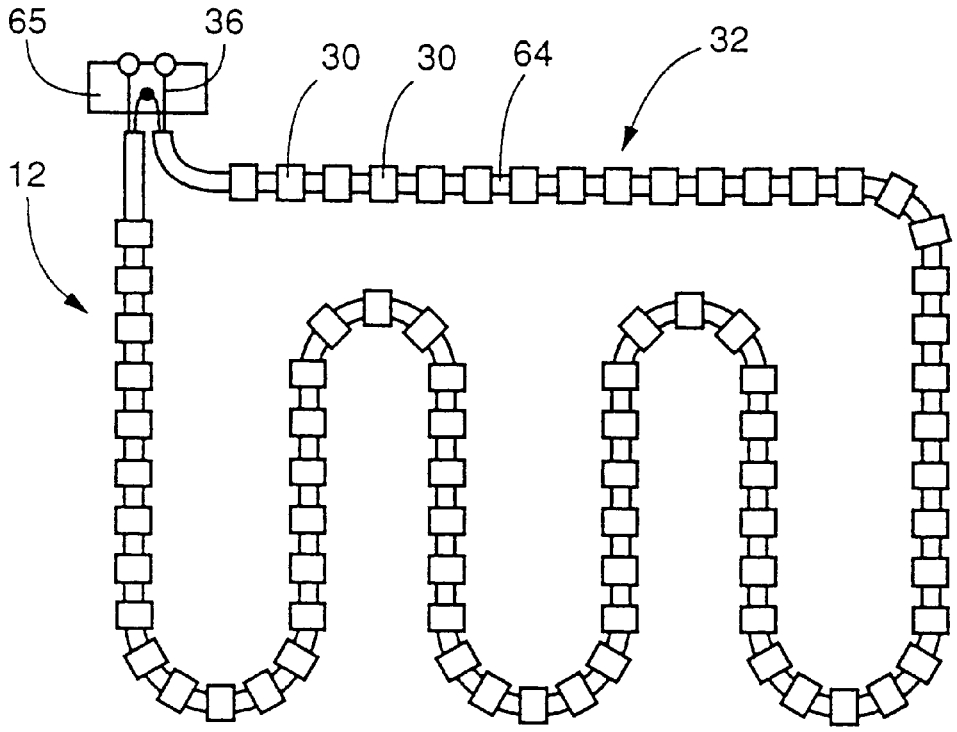
FIG. 7A is a view showing one example of use of the heat generating portion of FIG. 6.
Figure 7B:
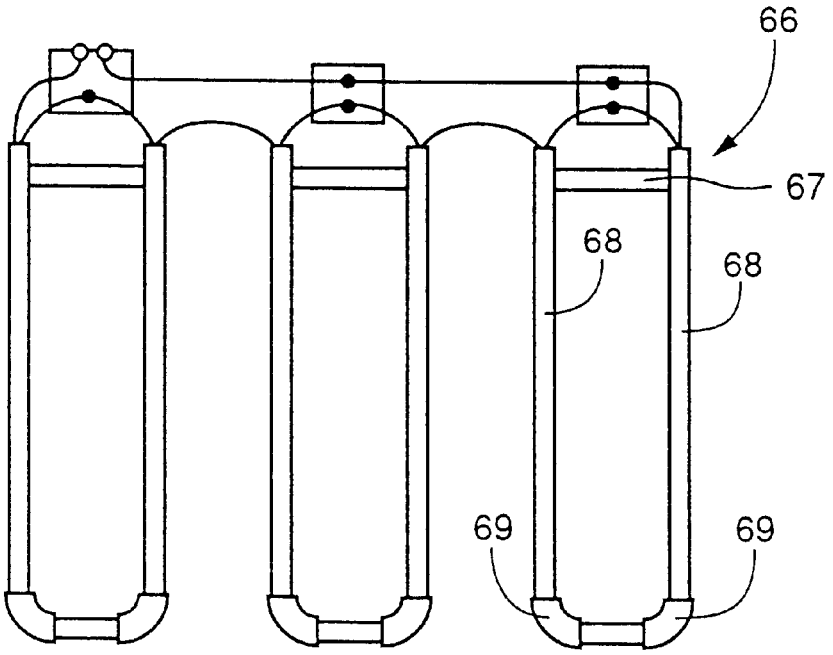
FIG. 7(b) (PRIOR ART)
FIG. 7B is a view showing a conventional heat generating portion.

In the specific embodiment of FIG. 6, the heat generating portion 12 is arranged such that the steel tube array 32 has a U-shape extending along two parallel lines and a semicircular line connecting the corresponding ends of the two parallel lines. However, the steel tube array 32 may be arranged to extend along a desired path, such as a combination of straight lines and curves, as indicated in FIG. 7A, by way of example. This arrangement of FIG. 7A corresponds to an arrangement of a conventional planar heat generating portion 66 using an assembly of straight steel tubes as shown in FIG. 7B. To produce the conventional planar heat generating portion 66, a long steel tube is cut into steel tubes 68 having lengths required for the particular locations of the steel tubes, and the steel tubes 68 are assembled into the heat generating portion 66, using suitable short-circuiting pieces 67 and connectors 69. On the other hand, the present heat generating portion 12 using the flexible tube 64 permits the steel tube array 32 to have desired length and configuration, extending along a desired path in a given plane. Reference numeral 65 in FIG. 7A denotes a connector console for the conductive wire 36.

Where the conductive wire consists of two or more conductive wire sections connected together, the connections of these sections must be located outside the long steel tubes 68 in the conventional planar heat generating portion 66. In the present heat generating portion 12, however, the connections may be located at any desired positions, owing to the use of the steel tubes 30 having a comparatively small length. Accordingly, a relatively large length of the conductive wire is exposed outside the steel tubes 68, though that length may be enclosed in a flexible sheath or tube made of a synthetic resin. For this reason, the conventional heating portion 66 suffers from a comparatively large amount of leakage of the line of magnetic force, which may possibly have any influence on the operating environment of the heating apparatus. In the heat generating portion 12 according to the present invention, the spacing between the adjacent steel tubes 30 can be made small enough to assure that the line of magnetic force substantially entirely lies within the steel tubes 30, with a minimum leakage of the line of magnetic force.

The heat generating portion 12 according to the second embodiment of this invention may be embedded in a concrete slab beneath a floor of a building, so that the heat generating portion 12 functions as a part of a floor heating apparatus. In this case, a lower concrete layer is first formed, and the heat generating portion 12 is placed on the lower concrete layer and is then covered by an upper concrete layer. Since the steel tube array 32 consists of the separate steel tubes 30 which are supported by the flexible tube 64, the upper surface of the upper concrete layer need not to have a high degree of straightness or flatness. Further, the pitch at which the steel tubes 30 are arranged along the path of the steel tube array 32 can be easily changed, making it possible to change the density of the steel tubes 30 per unit area, at different local portions of the floor. In addition, the use of the steel tubes 30 each having a relatively small length is effective to avoid cracking of the concrete slab due to a difference in coefficient of thermal expansion between the steel tubes 30 and the concrete slab, resulting in increased durability and enhanced operating reliability of the floor heating apparatus. Further, since the steel tubes 30 which may be vibration sources have a comparatively high resonance frequency and are arranged in spaced-apart relationship with each other, the electromagnetic vibration noise can be minimized, assuring a quiet operation of the floor heating apparatus.

The heat generating portion 12 may be disposed directly on a floor of a living room, or under a lattice structure, as a flexible elongate auxiliary heater. In this case, core should be exercised to avoid poor heat radiation while assuring a good appearance of the heater.

For electrical wiring in buildings, flexible tubes made of a synthetic resin are also used. These electrical wiring flexible tubes may be used as the flexible tube 64 in the heat generating portion 12. Such an electrical wiring flexible synthetic resin tube consists of large-diameter portions, small-diameter portions, and connecting portions each having a varying diameter and smoothly connecting the adjacent large-diameter and small-diameter portions. In cross section of this flexible synthetic resin tube in a plane parallel to the axial direction, the wall has a corrugated shape so that the tube can be easily flexed. Although the electrical wiring flexible synthetic resin tube has lower degrees of heat resistance and heat radiation than an electrical wiring metallic flexible tube, the former tube is less expensive and its use is recommended for easier installation and lower cost of manufacture, provided the temperatures of the flexible tube 64 and conductive wire 36 can be held lower than a permissible upper limit.

Figure 8:
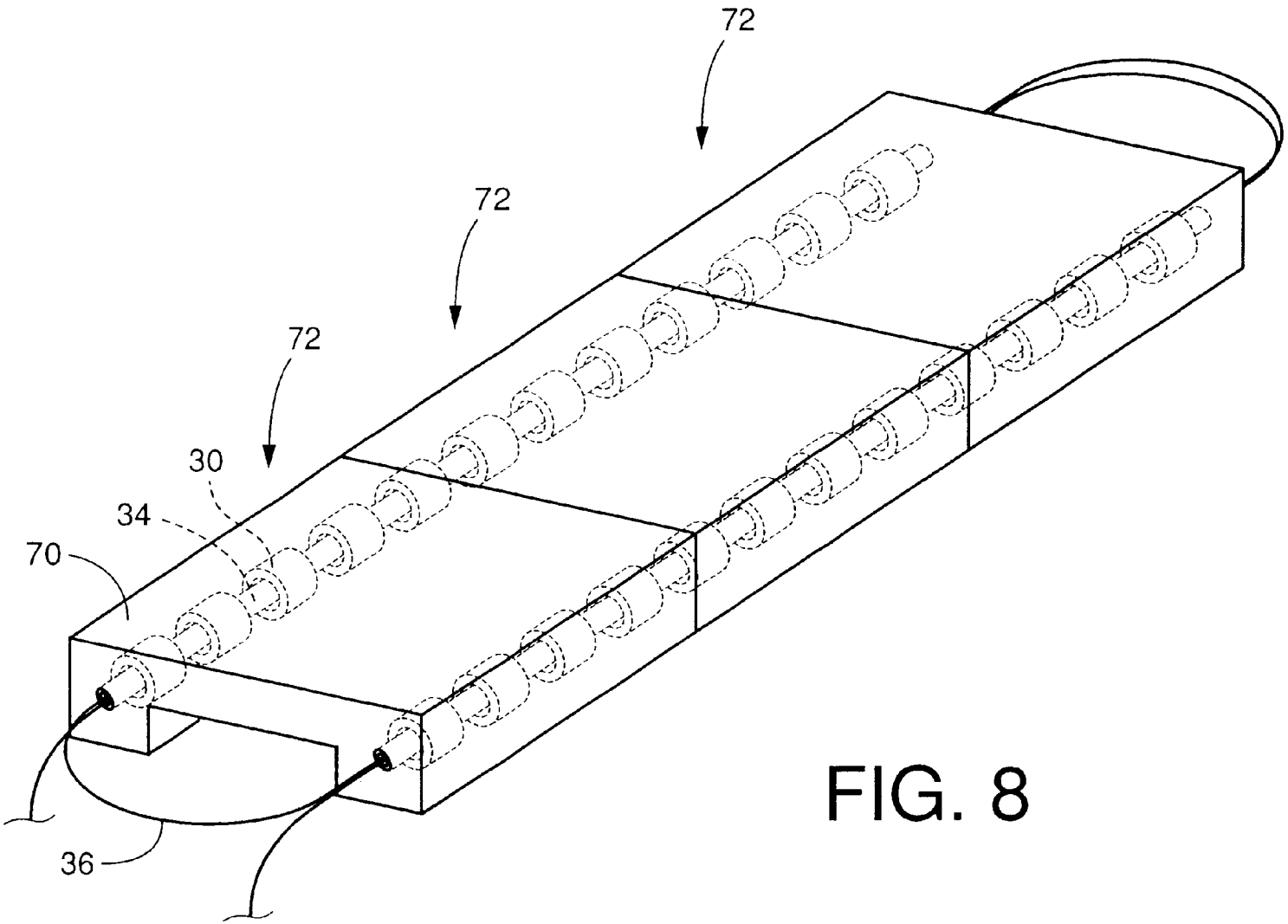
FIG. 8 is a perspective view of a heat generating portion of a surface current heating apparatus according to a further embodiment of the present invention.
Figure 9:
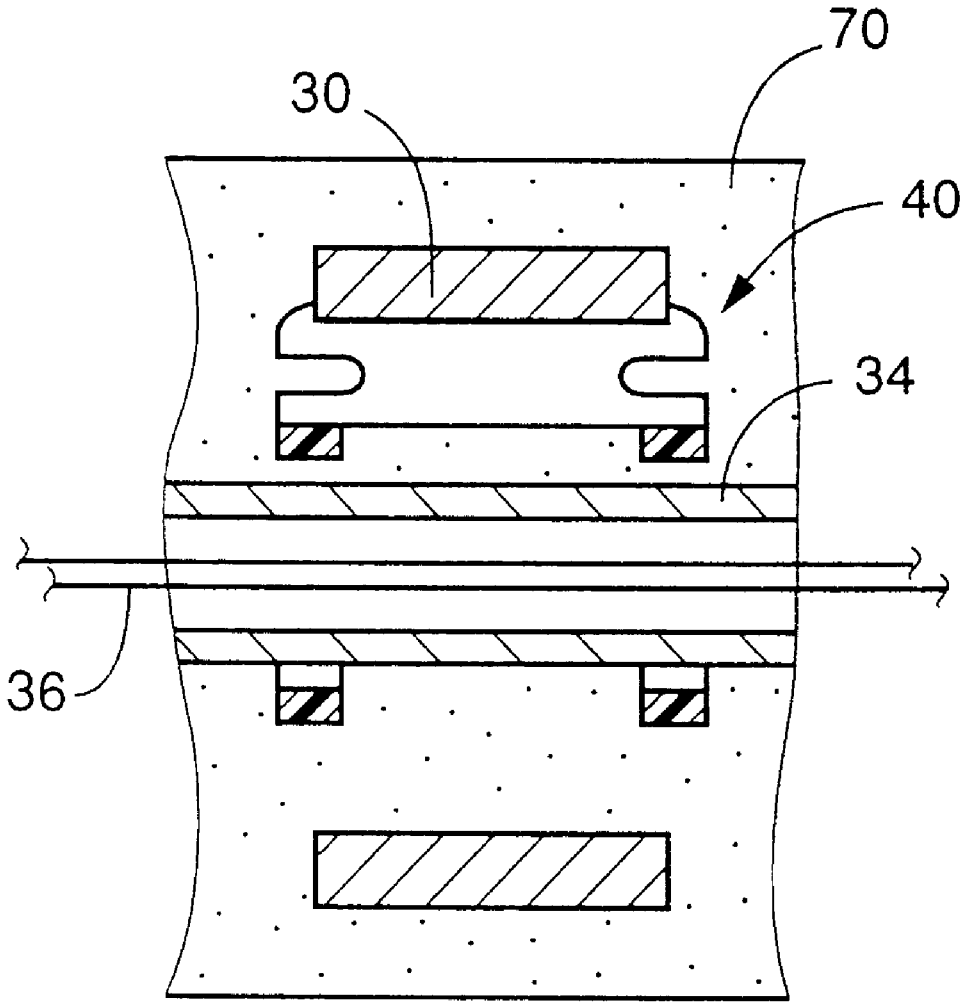
FIG. 9 is a fragmentary front elevational view in cross section of the heat generating portion of FIG. 8.

Referring next to FIGS. 8 and 9, there will be described a further embodiment of this invention. In the heating apparatus according to this embodiment, the heat generating portion 12 shown in FIG. 2 or 6 is embedded in stationary concrete blocks or slabs 70, so as to provide a plurality of heat generating modules 72. Each heat generating module 72 includes the steel tubes 30 and the support tube 34 (or flexible tube 64) embedded therein, and the conductive wire 36 is inserted through the support tube 34 or flexible tube 64 extending through the plurality of heat generating modules 72, when the modules 72 are placed on a floor such that the modules 72 are butted together at their end faces, as indicated in FIG. 8. When each heat generating module 72 is produced such that the steel tubes 30 and the support tube 34 or flexible tube 64 are embedded in the concrete block 70, a mushy concrete is poured also into a space between the inner circumferential surface of each steel tube 30 and the outer circumferential surface of the support tube 34 or flexible tube 64, as shown in FIG. 9. The cured concrete mass filling the space closely contacts the circumferential surfaces of the tubes 30, 34 (64). In operation, an alternating current is applied to the conductive wire 36 extending through the heat generating modules 72 placed on the floor, heat generated by the steel tubes 30 is transferred to the concrete blocks 70 through all of the surfaces of each steel tube 30, that is, through the inner and outer circumferential surfaces and the end faces of the steel tube 30. Heat generated due to copper loss of the conductive wire 36 is also transferred to the concrete blocks 70, through the outer circumferential surface of the support tube 34 or flexible tube 64. Thus, the concrete blocks 70 can be held at a sufficiently high temperature, while the temperatures of the steel tubes 30 and the support tube 34 or flexible tube 64 can be held comparatively low, so that the temperature rise of the conductive wire 36 can be reduced to effectively prevent deterioration of the heat-resistant vinyl chloride resin film covering the conductive wire 36. The number of the heat generating modules 72 used to provide a desired heating apparatus is selected depending upon the surface area to be covered by the apparatus. Thus, the modules 72 have a wide range of applications, and a desired heating apparatus can be obtained using the modules 72 at a relatively low cost owing to mass production of the modules.

In the present embodiment of FIGS. 8 and 9, each heat generating module 72 is produced in a process including the steps of: assembling the steel tubes 30, holder members 40 and support tube 34 or flexible tube 64 such that the steel tubes 30 are positioned by the holder members 40 relative to the support tube 34 or flexible tube 64; setting the assembly in a mold; and pouring a mushy concrete into the mold so as to fill the space with the cured concrete, to obtain the concrete block 70 in which the steel tubes 30 are embedded. However, the holder members 40 may be eliminated. In this case, an appropriate amount of mushy concrete is initially poured into a lower part of the mold. In the meantime, the steel tubes 30 and the support tube 34 or flexible tube 64 are positioned relative to each other by a suitable jig or fixture. Then, the assembly held by the jig is forced into the mass of the mushy concrete such that the axis of the support tube 34 or flexible tube 64 lies in the plane of the mushy concrete mass. When the mushy concrete has been solidified to an extent that prevents a movement of the assembly, an additional amount of mushy concrete is poured into the mold so that the assembly is completely embedded in the lower and upper layers of the concrete, which is allowed to be completely solidified or cured. Thus, the steel tubes 30 and the support tube 34 or flexible tube 64 can be embedded in the concrete block 70, in the predetermined positional relationship with each other, without using the holder members 40.

A still further embodiment of this invention will be described by reference to FIG. 10. In the heat generating portion 12 according to this embodiment, an adiabatic layer 76 and heat radiating members 78 are disposed between each steel tube 30 and the conductive wire 36. The adiabatic layer 76 is formed of a porous synthetic resin or a glass fiber, so as to cover the inner circumferential surface and the opposite end faces of each steel tube 30. Each heat radiating member 78 is formed of aluminum, and consists of a heat collecting tube 80 and a heat radiating fin 82 which extends radially outwardly from an axially intermediate portion of the heat collecting tube 80. The heat collecting tube 80 has an outside diameter smaller than the inside diameter of the steel tubes 30, and the heat radiating fin 82 has an outside diameter considerably larger than the outside diameter of the steel tubes 30 so that the heat radiating fin 82 extends radially outwardly of the outer circumferential surfaces of the steel tubes 30. Each heat radiating member 78 is disposed such that the two axial sections of the heat collecting tube 80 on the opposite axial sides of the heat radiating fin 82 are almost entirely located within the adjacent steel tubes 30. In other words, the heat radiating members 78 are disposed coaxially and in series with each other such that the adjacent axial end faces of the heat collecting tubes 80 of the adjacent heat radiating members 78 are located at the axially intermediate point of the corresponding steel tube 30. The adjacent heat radiating members 78 are butted together at the end faces of the heat collecting tubes 80 so that the conductive wire 36 is substantially entirely enclosed in the array of the heat radiating members 78.

The inside diameter of the adiabatic layers 76 is only slightly larger than the outside diameter of the heat collecting tubes 80. With the heat collecting tubes 80 inserted in the adjacent steel tubes 30, the steel tubes 30 are positioned relative to the heat radiating members 78 in the radial direction. Each adiabatic layer 76 has radially outwardly extending flanges at its opposite axial ends. The heat radiating members 78 and the steel tubes 30 are axially positioned relative to each other such that there exists a small axial clearance or gap between the surface of each flange of each adiabatic layer 76 and the opposite surface of the heat radiating fin 82 of the corresponding heat radiating member 78. Thus, the adiabatic layers 76 contribute to positioning the steel tubes 30 and the heat radiating members 78 relative to each other in both of the radial and axial directions.

In the present embodiment, a portion of the heat generated from the inner circumferential surfaces of the steel tubes 30 is transferred through the adiabatic layers 76 toward the collecting tubes 80 in the radially inward direction of the steel tubes 30. This portion of the heat and the heat generated due to copper loss of the conductive wire 36 are both collected by the heat collecting tubes 80, and are transferred to the heat radiating fins 82 by conduction, so that the heat is effectively radiated from the array of the steel tubes 30. Accordingly, a rise of the temperature within the steel tubes 30 is effectively reduced. Further, the transfer of the heat from the inner circumferential surfaces of the steel tubes 30 toward the conductive wire 36 by radiation is minimized by the adiabatic layers 76 and the heat collecting tubes 80 which are interposed between the steel tubes 30 and the conductive wire 36. Accordingly, a rise of the temperature of the conductive wire 36 is reduced, and the deterioration of the heat-resistant vinyl chloride resin film on the conductive wire 36 is effectively prevented.

The steel tubes 30 may be provided with at least one heat radiating fin extending radially outwardly from the outer circumferential surface, so as to improve the heat radiation from the steel tubes 30 and to more effectively reduce the amount of temperature rise of the conductive wire 36.

The present heat generating portion 12 may be used for a surface current heating apparatus for heating air or liquid. In this case, the steel tubes 30 or the heat radiating members 78 at the opposite ends of the array of the steel tubes 30 are held stationary at the predetermined positions, so as to maintain the array in the desired attitude in the presence of the aluminum heat radiating members 78. A support tube similar to the support tube 34 used in the preceding embodiments may be inserted between the heat radiating members 78 and the conductive wire 36, so as to more stably support the heat radiating members 78 and the steel tubes 30.

Figure 10:
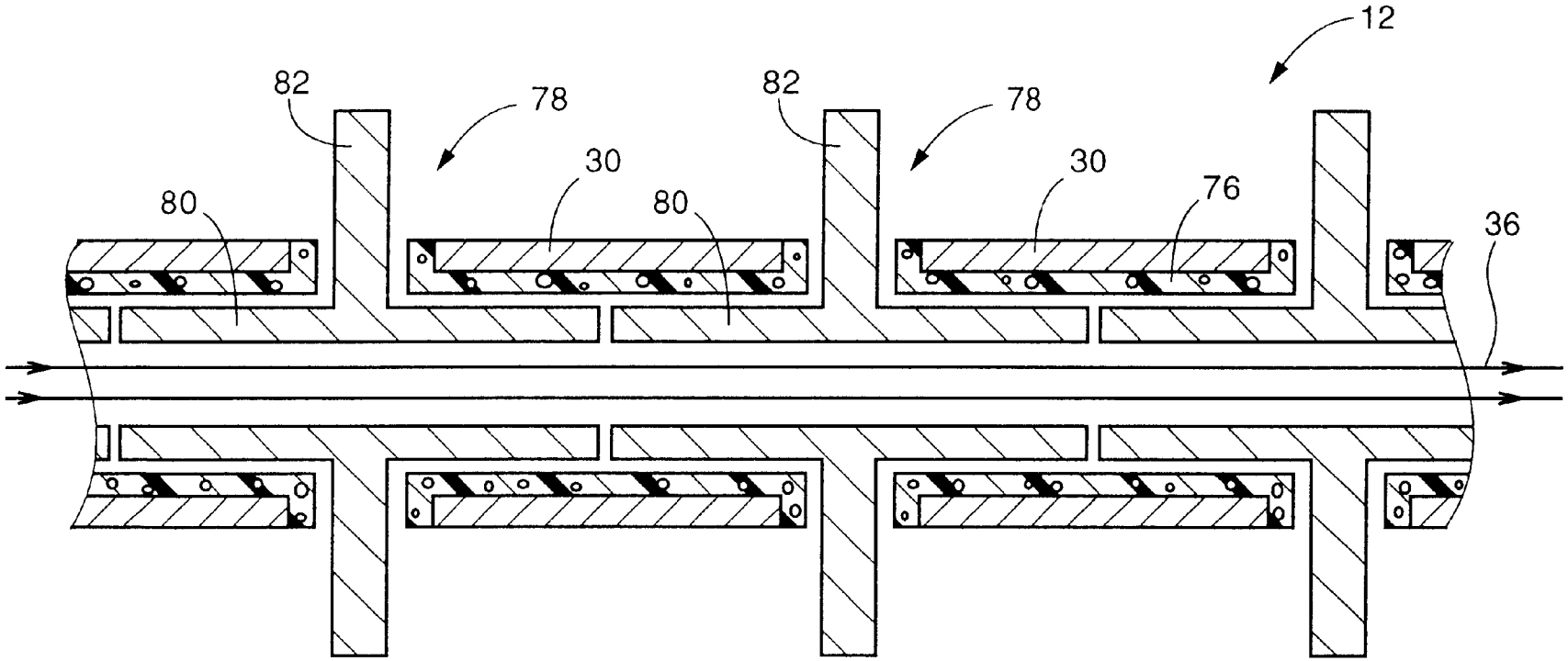
FIG. 10 is a fragmentary front elevational view in cross section of a heat generating portion of a surface current heating apparatus according to a still further embodiment of this invention.

The heat generating portion 12 of FIG. 10 may be embedded in the concrete block or slab 70 to provide the heat generating modules 72, as in the preceding embodiment of FIG. 8. In this case, however, the concrete is substantially absent within the steel tubes 30 and heat radiating members 78, but the heat can be efficiently transferred from the interior of the steel tubes 30 to the concrete block 70 through the heat radiating members 78, so that a rise of the temperature of the conductive wire 36 is effectively reduced.

In the embodiments described above, the support tube 34 or flexible tube 64 and the conductive wire 36 are held substantially coaxial with the steel tubes 30, in the presence of the holder members 40 or the solid adiabatic layers 76, thereby preventing local rise of the temperature of the conductive wire 36 due to the proximity or contact of the conductive wire to or with the inner circumferential surfaces of the steel tubes 30. However, the holder members 40 and the solid adiabatic layers 76 are not essential and may be eliminated.

Figure 11:
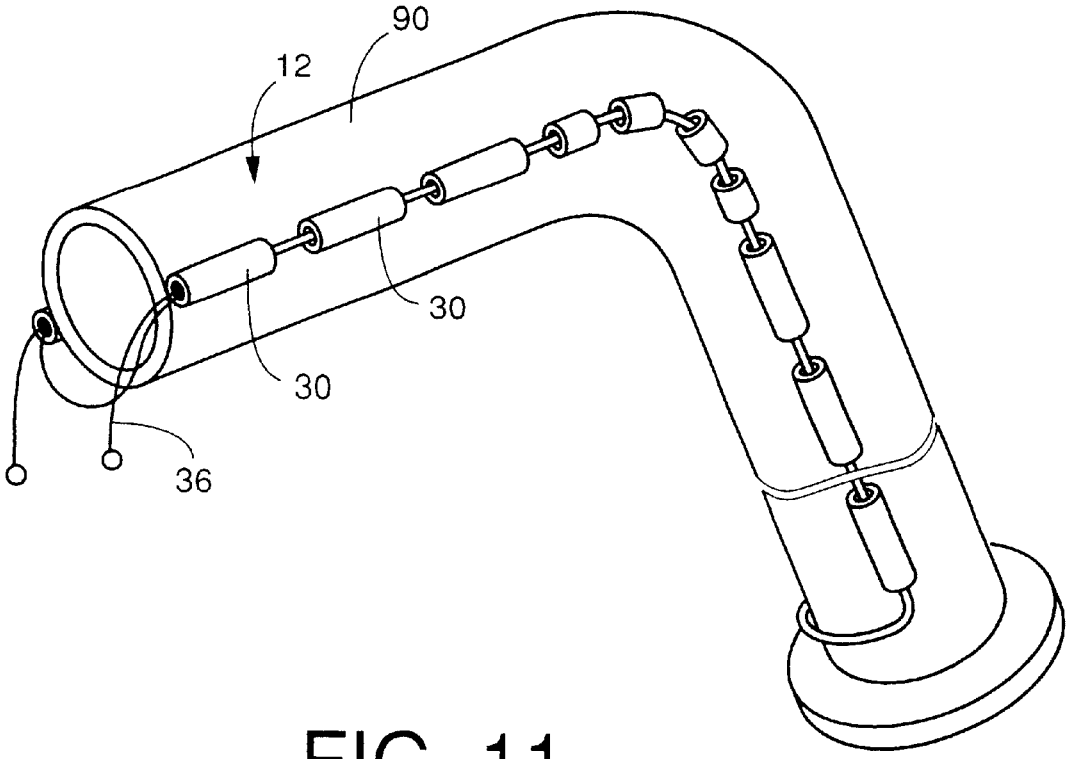
FIG. 11 is a perspective view of a heat generating portion of a surface current heating apparatus according to a yet further embodiment of this invention.

A yet further embodiment of the present invention will be described referring to FIG. 11. The heat generating portion 12 according to this embodiment is adapted to be used on a liquid transporting pipe 90. Namely, a multiplicity of the steel tubes 30 are fixed, by welding or any other suitable means, on the outer surface of the liquid transporting pipe 90, and the conductive wire 36 is inserted through the steel tubes 30. The steel tubes 30 are arranged so as to provide two or more arrays each array extending along the axis of the pipe 90, which is bent or curved in the present specific example. The steel tubes 30 in the straight portions of the arrays have larger length (axial dimensions) than the steel tubes 30 in the curved portions of the arrays. Further, the spacing between the adjacent steel tubes 30 is made larger in the straight portions than that in the curved portions. The support tube 34 or flexible tube 64 may be interposed between the steel tubes 30 and the conductive wire 36. The use of the steel tubes 30 whose length is relatively small permits easy arrangement of the steel tubes 30 along the bent or curved axis of the liquid transporting pipe 90.

The heat generating portion 12 according to the present embodiment is suitably used on the underside of steps of steel plate stairs.

Figure 12:
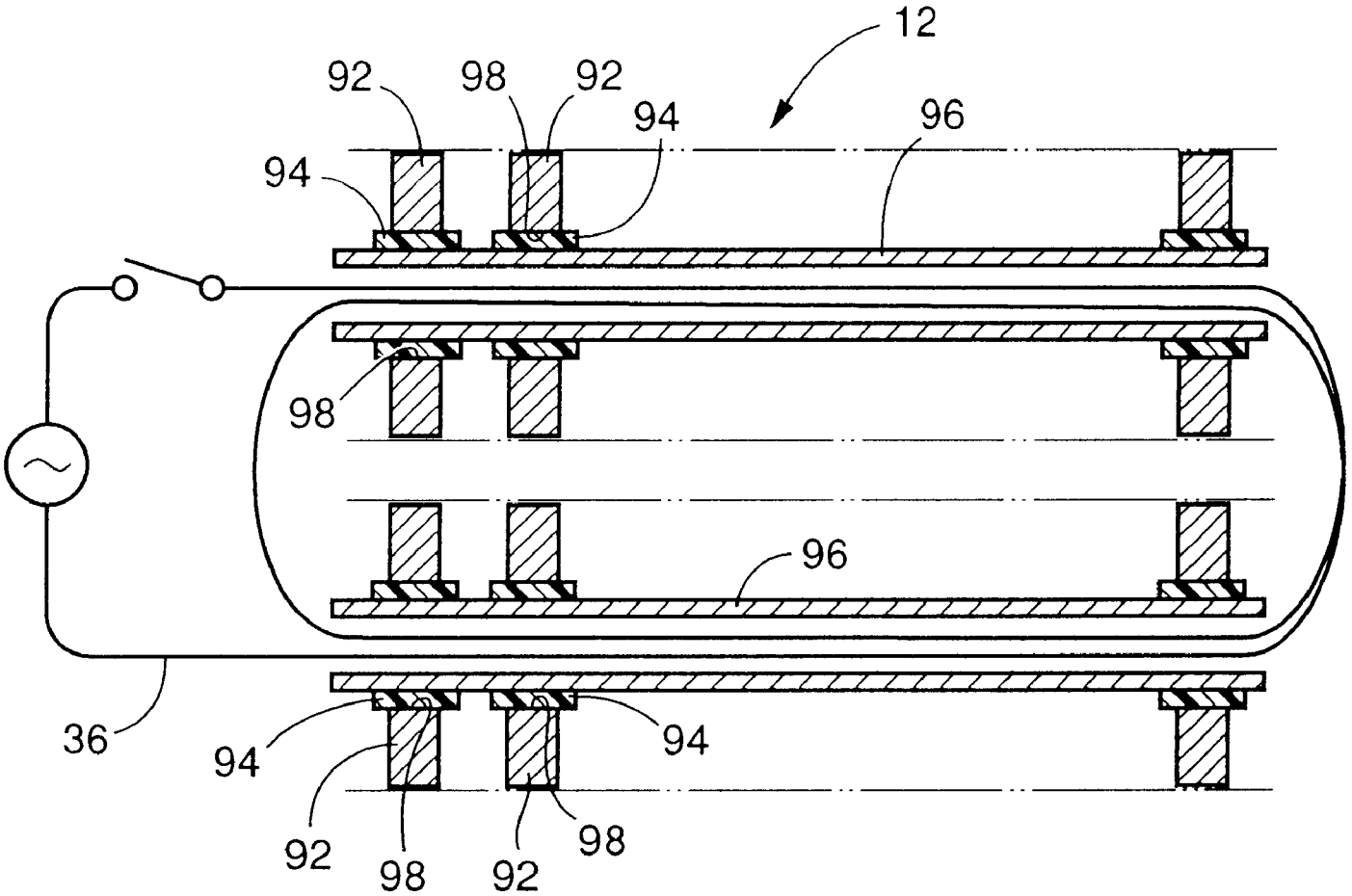
FIG. 12 is a cross sectional view of a heat generating portion of a surface current heating apparatus according still another embodiment of this invention.
Figure 13:
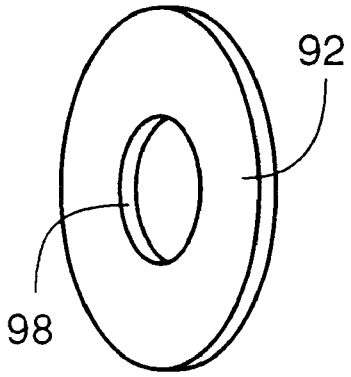
FIG. 13 is a perspective view of a ring used as a hollow heat generating member in the embodiment of FIG. 12.

In the embodiments which have been described, the steel tubes 30 are used as hollow heat generating members, plates or blocks having through-holes may be used as the hollow heat generating members. An example of this modification is illustrated in FIGS. 12 and 13. The heat generating portion 12 according to this modified embodiment uses steel rings 92 each having a center hole, as the hollow heat generating members. Each steel ring 92 has a cylindrical adiabatic member 94 extending through the center hole and bonded to the inner circumferential surface of the center hole. The adiabatic member 94 is formed of a heat-resistant synthetic resin. The steel rings 92 are mounted on protective or support tubes 96 such that the steel rings 92 are substantially equally spaced apart from each other in the axial direction of the support tubes 96, and such that such that the cylindrical adiabatic members 94 are fitted on the outer circumferential surfaces of the support tubes 96. Each of these support tubes 96 is formed of a non-magnetic material. The conductive wire 36 is inserted through the support tubes 96. In this heat generating portion 12, the steel rings 92 have a relatively large surface area of heat radiation, so that the temperature at the inner circumferential surface 98 of the steel rings 92 is held low enough to reduce a rise of the temperature of the conductive wire 36, while the steel rings 92 are capable of generating a large amount of heat.

In the embodiment of FIG. 12, spacers as described above with respect to the second embodiment of FIG. 6 may be mounted on the support tube 96 such that such that the spacers and steel rings 92 are alternately arranged. The spacers are effective to prevent tilting of the steel rings 92 relative to the axis of the support tube 96, and to maintain the relative position of each steel ring 92 and the support tube 96 in the axial direction.

Figure 14:
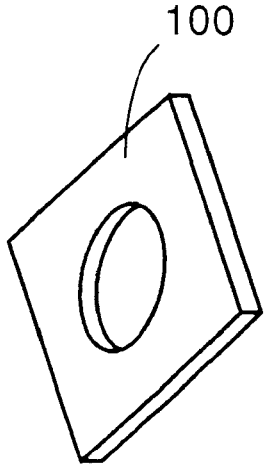
FIG. 14 is a perspective view used as a hollow heat generating member in yet another embodiment of this invention.
Figure 15:
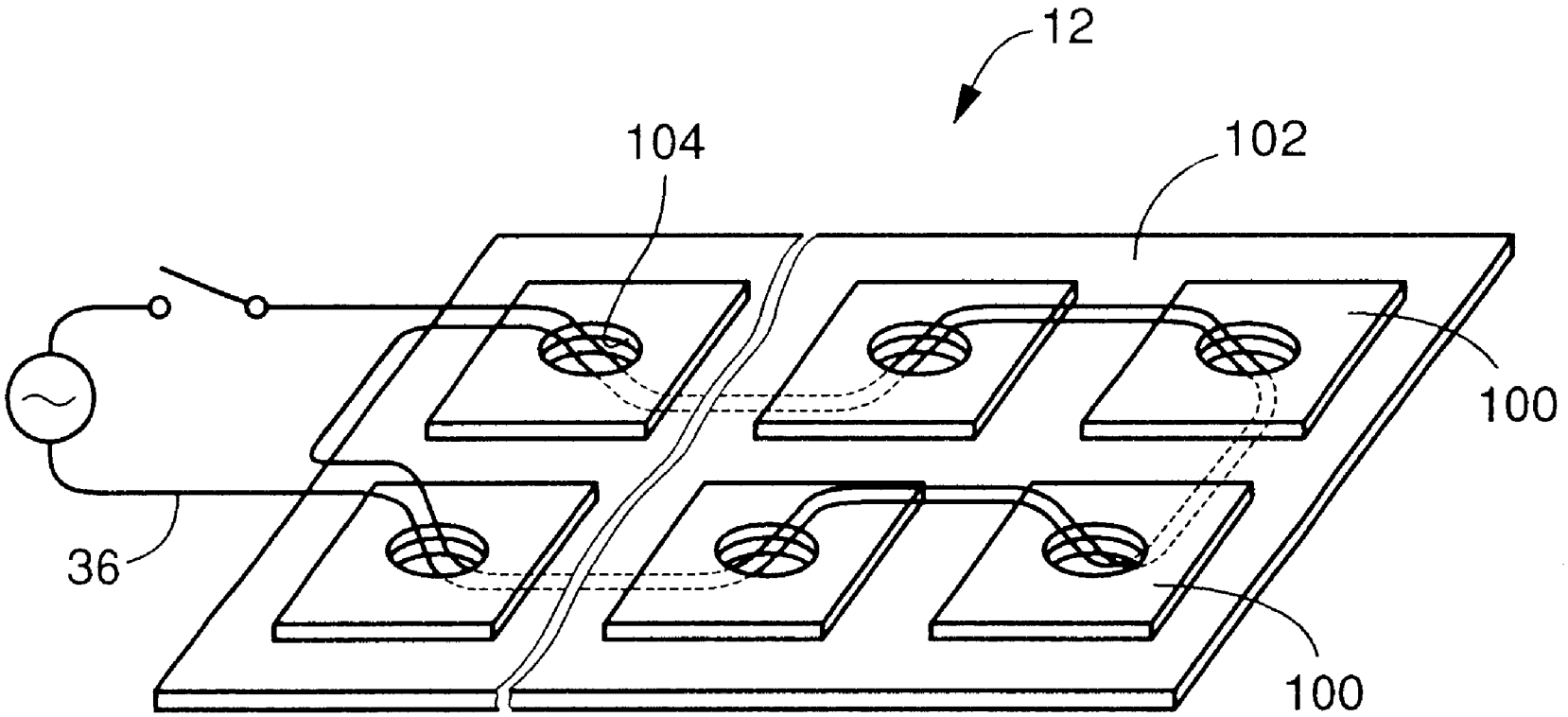
FIG. 15 is a perspective view of a heat generating portion of a surface current heating apparatus according to a further embodiment of this invention.

The steel rings 92 may be replaced by square or rectangular plates 100 each having a center hole, as shown in FIG. 14. The plate-like hollow heat generating members such as the steel rings 92 and rectangular steel plates 100 may be arranged with their center holes coaxially aligned with each other, as in the embodiment of FIG. 12, or alternatively arranged on a common planar (or curved) base member, as shown in FIG. 15. In the embodiment of FIG. 15, a plurality of square plates 100 each having a center hole are fixedly arranged at a predetermined pitch in two rows on a support plate or heat radiating plate 102, such that the center holes of the square plates 100 are aligned with respective holes formed through the heat radiating plate 102. The conductive wire 36 is passed through the holes of the square plates 100 and heat radiating plate 102, alternately in the opposite directions perpendicular to the plane of the heat radiating plate 102. That is, the conductive wire 36 extending through the hole of one of the square plates 100 in one direction from the upper surface toward the lower surface is passed through the hole of the adjacent square plate 100 in the same row, in the reserve direction from the lower surface toward the upper surface. In operation, an alternating current is applied to the conductive wire 36, the surface current flow near a circumferential surface 104 of each square plate 100, so that heat is generated from each square plate 100 and transferred by conduction to the heat radiating plate 102, whereby the heat is radiating from the large surface area of the heat radiating plate 102.

Figure 16:
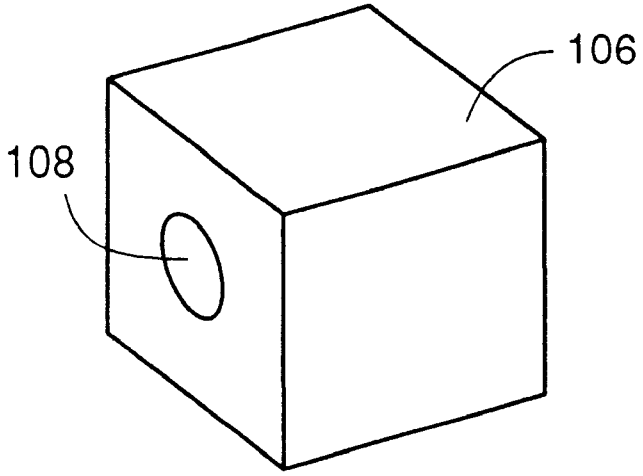
FIG. 16 is a perspective view of a block used as a hollow heat generating member in a still further embodiment of this invention.

An example of the hollow heat generating member in the form of a block is illustrated in FIG. 16. In this example, the block is a regular hexahedron or cube 106 having a through-hole 108 open in a pair of opposite faces thereof. Each open end of the through-hole 108 is located in the center of the corresponding face of the cube 106. The hollow block may be a block having a circular shape in transverse cross section and a through-hole formed therethrough along the centerline of the circle as seen the transverse cross section. The hollow heat generating member may not be recognized or considered as a tube, a plate or a block. Some hollow heat generating members may not be easily classified into the tube, plate and block. In practice, however, the classification of the hollow heat generating member into the specific configuration is not important.

Figure 17:
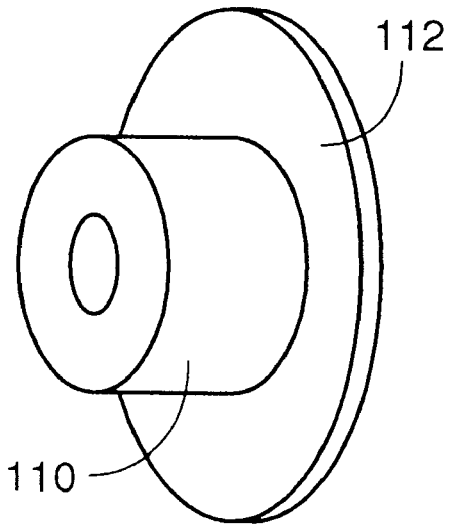
FIG. 17 is a perspective view of a block with a heat radiating fin used as a hollow heat generating member in a yet further embodiment of this invention.

The hollow heat generating member may be a cylindrical block (tube having a large wall thickness) 110 formed with a heat radiating fin 112 in the form of a ring having a comparatively small thickness, as shown in FIG. 17.

Figure 18:
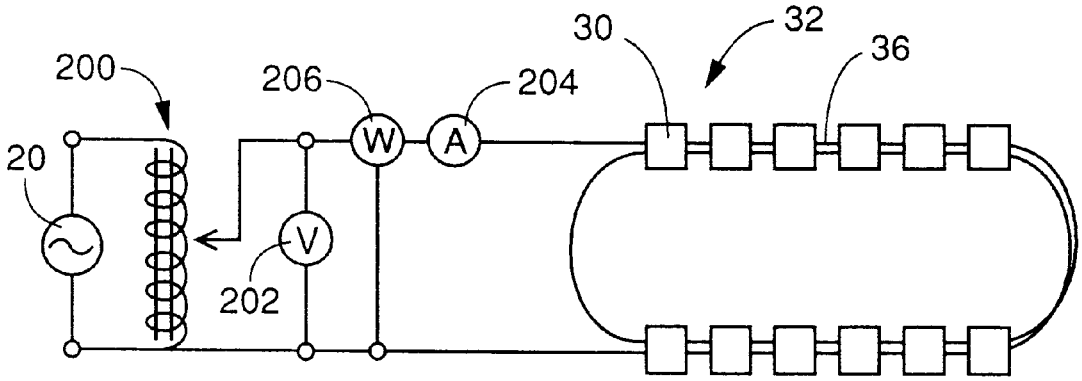
FIG. 18 is a circuit diagram of a device for an experiment conducted to confirm advantages of the present invention.

To confirm the performance of a surface current heating apparatus using the heat generating tubes 30 having comparatively small lengths, an experiment was conducted on two steel tube arrays 32 each of which consists of a plurality of steel tubes 30 and through which a conductive wire 36 is passed to provide a plurality of turns, as indicated in FIG. 18. The experiment was conducted in the atmosphere at a temperature of 22–30° C., with a voltage being applied to the conductive wire 36 from a commercially available 60 Hz power source 20 through a single-winding transformer 200 with a sliding brush. A voltmeter 202, an ammeter 204 and a wattmeter 206 were connected to the electric circuit including the conductive wire 36 and transformer 200, as indicated in FIG. 18. The voltage, current and power were measured by the voltmeter 202, ammeter 204 and wattmeter 206, respectively, and the measurements are indicated in the table of FIG. 19. The experiment was conducted under the following condition:

Steel tubes 30
- Kind: JIS G3452 SGP-B-20A
- Outside diameter: 27.2 mm
- Wall thickness: 2.8 mm Conductive wire 36
- JIS C3306 vinyl plane cord (VFF; 2 cores; 1.25 $mm^2$/core) wherein two cores are connected in series Temperature of the conductive wire 36
- The temperature of the conductive wire 36 was held within a range of 22–50° C. The experiment was interrupted when the temperature of the steel tubes 30 or conductive wire 36 exceeded the upper limit of 50° C., so that the experiment was resumed after the cooling of the steel tubes 30 and conductive wire 36 to a temperature below the upper limit.

It will be understood from the table of FIG. 19 that the amount of heat generated (electromagnetic loss) per unit length of the steel tubes 30 does not vary with the length of the steel tubes 30. That is, a practically sufficient amount of heat could be generated irrespective of the length of the steel tubes 30. It will also be understood that the electromagnetic loss of the steel tubes 30 was considerably larger than the copper loss of the conductive wire 36. This fact confirmed the advantage of the present invention.

To investigate an influence of the flexible tube 64 formed from a cold-rolled steel strip, another experiment was conducted, and the electromagnetic loss was measured using a test device as used in the above-indicated experiment. The experiment consisted of Test Nos. 1–4, as indicated in the table of FIG. 20. In Test Nos. 1 and 2, there were used two steel arrays 32 each consisting of 20 steel tubes 30 (JIS SGP-B-20A) having a length of 50 mm which axially spaced apart from each other by a distance of 5 mm. In Test No. 1, the conductive wire 36 was passed through the steel tubes 30 of the two steel tube arrays 32, without using any flexible tubes. In Test No. 2, a vinyl-covered class-1 metallic flexible conductive tube (equivalent to the combination of the conductive wire 36 and the metallic flexible tube 64) having a length of 1.1 m was passed through each steel tube array 32. In Test No. 3, only the two 1.1 m-long vinyl-covered class-1 metallic flexible conductive tubes were used. In Test No. 4, only the conductive wire 36 was used.

It will be understood from the table of FIG. 20 that the influence of the metallic flexible tubes 64 could not be clearly recognized due to an experiment error, and is therefore considered to be extremely small.

To confirm the performance of surface current heating apparatus using hollow heat generating members in the form of plates, an experiment was conducted the hollow heat generating members in the form of ring-shaped members and rectangular plates, using the test device of FIG. 18. The experiment was conducted under the following condition:

Ring-shaped heat generating members
- Round plane washers (equivalent to JIS B 1256 having nominal diameter of 16 mm) made of JIS G 3101 and coated with an electrolytic zinc plating film
- Average outside diameter: 31.2 mm
- Average inside diameter: 17.2 mm
- Average thickness: 2.6 mm
- Number of washers: 400 (total thickness=1.04 m)
- Arrangement: two 1 m-long arrays each consisting of 200 washers Rectangular heat generating members
- Rectangular plane washers (equivalent to JIS B 1256 having nominal diameter of 14 mm) made of JIS G 3131 and coated with an electrolytic zinc plating film
- Average side length: 42.0 mm
- Average through-hole dia.: 14.1 mm
- Average thickness: 3.1 mm
- Number of washers: 334 (total thickness=1.04 m)
- Arrangement: two 1.5 m-long arrays each consisting of 167 washers Conductive wire 36

JIS C3306 vinyl plane cord (VFF; 2 cores; 1.25 $mm^2$/core) wherein two cores are connected in series Number of turns: 10

The round and rectangular plane washers may be coated with a chromate film rather than an electrolytic zinc plating film.

The result of the experiment is indicated in the table of FIG. 21. The table of FIG. 22 shows some of the tests in the experiment of FIG. 21 as compared with some of the tests in FIG. 19 in which the comparatively short steel tubes were used. It will be understood from the table of FIG. 21 that the power consumption due to the electromagnetic loss of the heat generating members in the form of plates was considerably larger than the power consumption due to the copper loss of the insulated conductive wire, irrespective of whether the plates are the ring-shaped members or the rectangular plates. Thus, the effectiveness of using the plates as the heat generating members according to the present invention was confirmed. It will be understood from the table of FIG. 22 that the electromagnetic loss per total thickness of 1 m of the heat generating plates was larger than that of the heat generating tubes. It is clear, without calculation, that the total heat radiating surface per total thickness of 1 m of the heat generating plates is larger than that per total length of 1 m of the heat generating tubes. In this respect, the hollow heat generating members in the form of plates are effective to generate heat.

While the presently preferred embodiments of this invention have been described above in detail by reference to the accompanying drawings, for illustrative purpose only, it is to be understood that the invention is not limited to the details of the illustrated embodiments, but may be embodied with various changes, modifications and improvements, which may occur to those skilled in the art.

What is claimed is:

1. A surface current heating apparatus, comprising:

a plurality of hollow heat generating members each made of a ferromagnetic material and having a through-hole, said hollow heat generating members being spaced apart from each other so as to provide at least one array of said hollow heat generating members;

an electrically conductive wire electrically insulated and extending through said through-hole of said each hollow heat generating member, an alternating current from a power source being applied to said electrically conductive wire, to cause a surface current to flow through a skin layer of said each hollow heat generating member which is located near an inner surface of said through-hole, whereby heat is generating from said skin layer; and at least one support tube made of a non-magnetic metal and having a bore, said at least one support tube extending through said through-hole of said each hollow heat generating member, and wherein said electrically conductive wire extends through said at least one support tube such that said electrically conductive wire has a plurality of turns each of which passes a bore of each of said at least one support tube.

2. A surface current heating apparatus according to claim 1, wherein said at least one array of said hollow heat generating members includes at least one array consisting of a plurality of heat generating tubes each of which has an axial length no more than 20 times an outside diameter thereof.

3. A surface current heating apparatus according to claim 1, wherein said at least one array of said hollow heat generating members includes at least one array each consisting of a plurality of heat generating tubes which are arranged along a substantially entire portion of a closed loop, said electrically conductive wire extending through said each array of said heat generating tubes and along said closed loop, an axial length of a shortest one of said heat generating tubes in said each array being no more than 1/7 of a total length of said at least one array of said heat generating tubes.

4. A surface current heating apparatus according to claim 3, wherein said at least one array of said heat generating tubes includes a straight array of said heat generating tubes each having an axial length no more than 1/3 of a length of said straight array.

5. A surface current heating apparatus according to claim 1, wherein said at least one array of hollow heat generating members includes at least one curved array each consisting of a plurality of heat generating tubes which are arranged along a curved line which can be approximated by a circular arc, each of said heat generating tubes having an axial length no more than than 1/6 of a circumference of a circle which includes said circular arc.

6. A surface current heating apparatus according to claim 1, wherein said at least one array of hollow heat generating members includes at least one array of heat generating tubes which are axially spaced apart from each other by a distance no more than three times an axial length of said heat generating tubes.

7. A surface current heating apparatus according to claim 1, wherein said plurality of heat generating members include a plurality of plates each having a through-hole.

8. A surface current heating apparatus according to claim 1, wherein said plurality of said hollow heat generating members include a plurality of blocks each having a through-hole.

9. A surface current heating apparatus according to claim 1, wherein said at least one support tube comprises a flexible tube which is flexible and which extends through said through-hole of said each hollow heat generating member, and wherein said electrically conductive wire extends through said flexible tube.

10. A surface current heating apparatus according to claim 9, wherein said flexible tube is made of a non-metallic material.

11. A surface current heating apparatus according to claim 9, wherein said flexible tube is made of a non-magnetic metallic material.

12. A surface current heating apparatus according to claim 9, wherein said flexible tube has a thickness not larger than a thickness of a cylindrical wall of a heat generating tube as said each heat generating member.

13. A surface current heating apparatus according to claim 9, wherein said flexible tube is made of a magnetic metal and has a transverse cross sectional shape which is not magnetically closed.

14. A surface current heating apparatus according to claim 1, further comprising a heat radiating member including: a heat collecting portion made of a non-magnetic metal and interposed between an inner surface of the through-hole of said each hollow heat generating member and said electrically conductive wire, for collecting the heat generated from said skin layer of said each hollow heat generating member; and a heat radiating portion located outside said each hollow heat generating member, for radiating the heat collected by said heat collecting portion.

15. A surface current heating apparatus according to claim 14, wherein said heat collecting portion of said heat radiating member includes a heat collecting tube located inside said each heat generating member, and said heat radiating portion includes a heat radiating fin which extends radially outwardly from said heat collecting tube, said apparatus further comprising an adiabatic layer disposed between said heat collecting tube and said hollow heat generating member, said adiabatic layer having a coefficient of thermal expansion lower than those of said heat collecting tube and said hollow heat generating member.

16. A surface current heating apparatus according to claim 15, wherein said heat collecting tube includes an axially central portion, and axially opposite end portions which are located on opposite sides of said axially central portion, said heat radiating fin extending radially outwardly from an outer circumferential surface of said axially central portion of said heat collecting tube, said axially opposite end portions being respectively located within adjacent ones of said plurality of hollow heat generating members.

17. A surface current heating apparatus according to claim 15, wherein said adiabatic layer is formed of a solid material.

18. A surface current heating apparatus according to claim 1, wherein said plurality of hollow heat generating members are embedded in a solid member made of a non-magnetic material, so as to provide a one-piece structure.

19. A surface current heating apparatus according to claim 18, wherein said solid member is made of a material which is not electrically conductive.

20. A surface current heating apparatus according to claim 18, wherein said material of said solid member is selected from a group consisting of: concrete; synthetic resin; gypsum; and ceramic material.

21. A surface current heating apparatus according to claim 18, wherein a space within said each hollow heat generating member is filled with a portion of said solid member such that an inner surface of said through-hole is in contact with a material of said portion of said solid member.

22. A combination consisting of a plurality of one-piece structures each constructed according to claim 18.

23. A surface current heating apparatus according to claim 1, wherein each of said plurality of hollow heat generating members consists of a heat generating tube, said apparatus further comprising a support tube made of a magnetic material and having a cylindrical wall thickness no more than ⅕ of that of said heat generating tube, said support tube extending through said heat generating tube while said electrically conductive wire extending through said support tube.

24. A surface current heating apparatus according to claim 1, further comprising a support tube made of a magnetic metal and having a transverse cross sectional shape which does not provide a closed magnetic path, said support tube extending through said through-hole of said each hollow heat generating member, and wherein said electrically conductive wire extends through said support tube.

25. A surface current heating apparatus according to claim 1, further comprising a holder device for holding said plurality of hollow heat generating members in a mutually spaced-apart relationship with each other, while permitting flows of a fluid through said through-hole of said each hollow heat generating member to an outside of said each hollow heating generating member.

26. A surface current heating apparatus according to claim 1, wherein said at least one support tube consists of two support tubes which support respective two arrays of said hollow heat generating members.

27. A surface current heating apparatus, comprising:

a plurality of hollow heat generating members each made of a ferromagnetic material and having a through-hole, said hollow heat generating members being spaced apart from each other so as to provide at least one array of said hollow heat generating members; and an electrically conductive wire electrically insulated and extending through said through-hole of said each hollow heat generating member, an alternating current from a power source being applied to said electrically conductive wire, to cause a surface current to flow through a skin layer of said each hollow heat generating member which is located near an inner surface of said through-hole, whereby heat is generating from said skin layer, and wherein said at least one array of said hollow heat generating members includes at least one array consisting of a plurality of heat generating tubes each of which has an axial length no more than 20 times an outside diameter thereof.

28. A surface current heating apparatus, comprising:

a plurality of hollow heat generating members each made of a ferromagnetic material and having a through-hole, said hollow heat generating members being spaced apart from each other so as to provide at least one array of said hollow heat generating members; and an electrically conductive wire electrically insulated and extending through said through-hole of said each hollow heat generating member, an alternating current from a power source being applied to said electrically conductive wire, to cause a surface current to flow through a skin layer of said each hollow heat generating member which is located near an inner surface of said through-hole, whereby heat is generating from said skin layer, and wherein said at least one array of said hollow heat generating members includes at least one array consisting of a plurality of heat generating members includes at least one array consisting of a plurality of heat generating tubes which are arranged along a substantially entire portion of a closed loop, said electrically conductive wire extending through said each array of said heat generating tubes and along said closed loop, an axial length of a shortest one of said heat generating tubes in said each array being no more than ⅐ of a total length of said at least one array of said heat generating tubes.

29. A surface current heating apparatus according to claim 28, wherein said at least one array of said heat generating tubes includes a straight array of said heat generating tubes each having an axial length no more than ⅓ of a length of said straight array.

30. A surface current heating apparatus, comprising:

a plurality of hollow heat generating members each made of a ferromagnetic material and having a through-hole, said hollow heat generating members being spaced apart from each other so as to provide at least one array of said hollow heat generating members; and an electrically conductive wire electrically insulated and extending through said through-hole of said each hollow heat generating member, an alternating current from a power source being applied to said electrically conductive wire, to cause a surface current to flow through a skin layer of said each hollow heat generating member which is located near an inner surface of said through-hole, whereby heat is generating from said skin layer, and wherein said at least one array of said hollow heat generating members includes at least one array of heat generating tubes which are axially spaced apart from each other by a distance not larger than three times an axial length of said heat generating tubes.

* * * * *